US011670852B2

(12) United States Patent
Lei et al.

(10) Patent No.: US 11,670,852 B2
(45) Date of Patent: Jun. 6, 2023

(54) SCANNING ANTENNA

(71) Applicant: Shanghai Tianma Micro-Electronics Co., Ltd., Shanghai (CN)

(72) Inventors: Dengming Lei, Shanghai (CN); Kerui Xi, Shanghai (CN); Zhenyu Jia, Shanghai (CN); Ping Su, Shanghai (CN); Huihui Jiang, Shanghai (CN); Yi Wang, Shanghai (CN); Wei Li, Shanghai (CN); Huan Li, Shanghai (CN); Feng Qin, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/574,344

(22) Filed: Jan. 12, 2022

(65) Prior Publication Data

US 2023/0138258 A1 May 4, 2023

(30) Foreign Application Priority Data

Oct. 28, 2021 (CN) ..... 202111261997.2

(51) Int. Cl.
*H01Q 3/36* (2006.01)

(52) U.S. Cl.
CPC ..... *H01Q 3/36* (2013.01)

(58) Field of Classification Search
CPC ..... H01Q 3/36; H01Q 3/38
See application file for complete search history.

(56) References Cited

U.S. PATENT DOCUMENTS

| | | | | |
|---|---|---|---|---|
| 11,069,976 | B1 * | 7/2021 | Xi | H01Q 3/36 |
| 11,450,972 | B2 * | 9/2022 | Wang | H01Q 21/0075 |
| 2012/0235881 | A1 * | 9/2012 | Pan | H01Q 25/00 343/893 |
| 2019/0103671 | A1 * | 4/2019 | Dong | H01Q 1/364 |
| 2020/0059005 | A1 * | 2/2020 | Wu | H01P 1/18 |
| 2020/0343635 | A1 * | 10/2020 | Hu | H01Q 3/36 |
| 2020/0388934 | A1 * | 12/2020 | Misaki | H01Q 3/44 |

(Continued)

FOREIGN PATENT DOCUMENTS

| | | | |
|---|---|---|---|
| CN | 105896082 | A | 8/2016 |
| CN | 107331973 | A | 11/2017 |

(Continued)

*Primary Examiner* — Awat M Salih
(74) *Attorney, Agent, or Firm* — Anova Law Group PLLC

(57) ABSTRACT

A scanning antenna is provided in the present disclosure. The scanning antenna includes a first substrate and a second substrate which are arranged oppositely; a liquid crystal layer between the first substrate and the second substrate; and a feed signal access terminal and a plurality of phase shift units, where the plurality of phase shift units is connected with each other, each phase shift unit is connected to the feed signal access terminal, and electrical lengths between at least two phase shift units and the feed signal access terminal are different. The present disclosure not only realizes one-dimensional wave beam scanning, but also has desirable scanning effect. The bias voltage is not needed to be independently applied to each phase shift unit, which can greatly simplify the bias voltage line configuration and be beneficial for reducing production cost and wiring difficulty.

19 Claims, 32 Drawing Sheets

(56) References Cited

U.S. PATENT DOCUMENTS

| | | | | |
|---|---|---|---|---|
| 2021/0080765 | A1* | 3/2021 | Hu | H01P 1/184 |
| 2022/0115780 | A1* | 4/2022 | Wang | H01Q 3/36 |

FOREIGN PATENT DOCUMENTS

| | | | |
|---|---|---|---|
| CN | 108803096 | A | 11/2018 |
| CN | 109728431 | A | 5/2019 |
| CN | 110350310 | A | 10/2019 |
| CN | 110649356 | A | 1/2020 |
| CN | 111525264 | A | 8/2020 |
| CN | 112436275 | A | 3/2021 |

* cited by examiner

SCANNING ANTENNA

CROSS-REFERENCE TO RELATED APPLICATION

This application claims the priority of Chinese Patent Application No. 202111261997.2, filed on Oct. 28, 2021, the content of which is incorporated herein by reference in its entirety.

TECHNICAL FIELD

The present disclosure generally relates to the field of wireless communication technology and, more particularly, relates to a scanning antenna.

BACKGROUND

Based on the anisotropy characteristics of liquid crystal molecules, the liquid crystal antenna may use electrical signals to control the arrangement of liquid crystal molecules, thereby changing the microwave dielectric parameter of each phase shift unit, controlling the phase of the microwave signal in each unit, and finally realizing the direction control of the antenna radiation beam. According to the wave beam scanning dimensions, the scanning antennas may be divided into one-dimensional scanning antennas and two-dimensional scanning antennas, which may be applied to scenarios such as satellite communications and 5G millimeter wave base stations.

In the existing two-dimensional scanning liquid crystal antenna, it is necessary to normally apply an independent bias voltage to each phase shift unit to drive corresponding liquid crystal molecules to deflect, thereby realizing independent phase control of each phase shift unit. Therefore, a relatively complicated bias circuit and a high-cost drive circuit control board may need to be configured. When the scale of the antenna array increases, the complexity and cost increase by orders of magnitude. In addition, in order to prevent the bias voltage from cross talking between the phase shifters (i.e., shift units), it is necessary to normally couple the feed power division network and the phase shifters, which may inevitably introduce coupling loss. However, for specific application scenarios, such as high-speed trains, subway lines and the like, technically complex and costly two-dimensional beam scanning antennas are not needed, and only one-dimensional beam scanning antennas are needed.

Therefore, there is a need to provide a scanning antenna which may realize one-dimensional wave beam scanning, may not require complex bias lines and have coupling loss, and may have relatively low antenna cost.

SUMMARY

One aspect of the present disclosure provides a scanning antenna. The scanning antenna includes a first substrate and a second substrate which are arranged oppositely; a liquid crystal layer between the first substrate and the second substrate; and a feed signal access terminal and a plurality of phase shift units. The plurality of phase shift units is connected with each other, each phase shift unit is connected to the feed signal access terminal, and at least two phase shift units of the plurality of phase shift units have different electrical lengths with the feed signal access terminal.

Other aspects of the present disclosure can be understood by those skilled in the art in light of the description, the claims, and the drawings of the present disclosure.

BRIEF DESCRIPTION OF THE DRAWINGS

The drawings incorporated in the specification and constituting a part of the specification illustrate embodiments of the present disclosure, and together with the description are used to explain the principle of the present disclosure.

DETAILED DESCRIPTION

Figure 1:
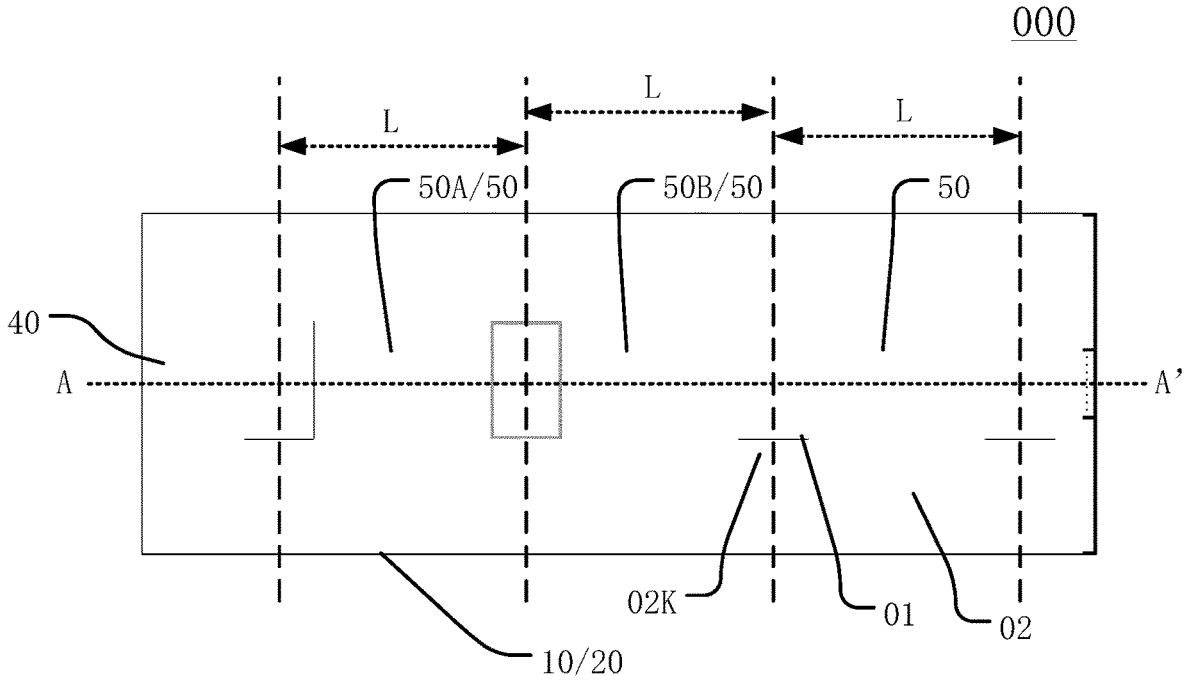
FIG. 1 illustrates a planar structural schematic of an exemplary scanning antenna according to various embodiments of the present disclosure.

Various exemplary embodiments of the present disclosure are be described in detail with reference to the accompanying drawings. It should be noted that unless specifically stated otherwise, the relative arrangement of components and steps, numerical expressions and numerical values set forth in these embodiments do not limit the scope of the present disclosure.

The following description of at least one exemplary embodiment may be merely illustrative and may not be used to limit the present disclosure and its application or use.

The technologies, methods, and equipment known to those skilled in the art may not be discussed in detail, but where appropriate, the technologies, methods, and equipment should be regarded as part of the specification.

In all the examples shown and discussed herein, any specific value should be interpreted as merely exemplary, rather than as a limitation. Therefore, other examples of the exemplary embodiment may have different values.

It should be noted that similar reference numerals and letters indicate similar items in the following drawings. Therefore, once an item is defined in one drawing, it does not need to be further discussed in the subsequent drawings.

Figure 2:
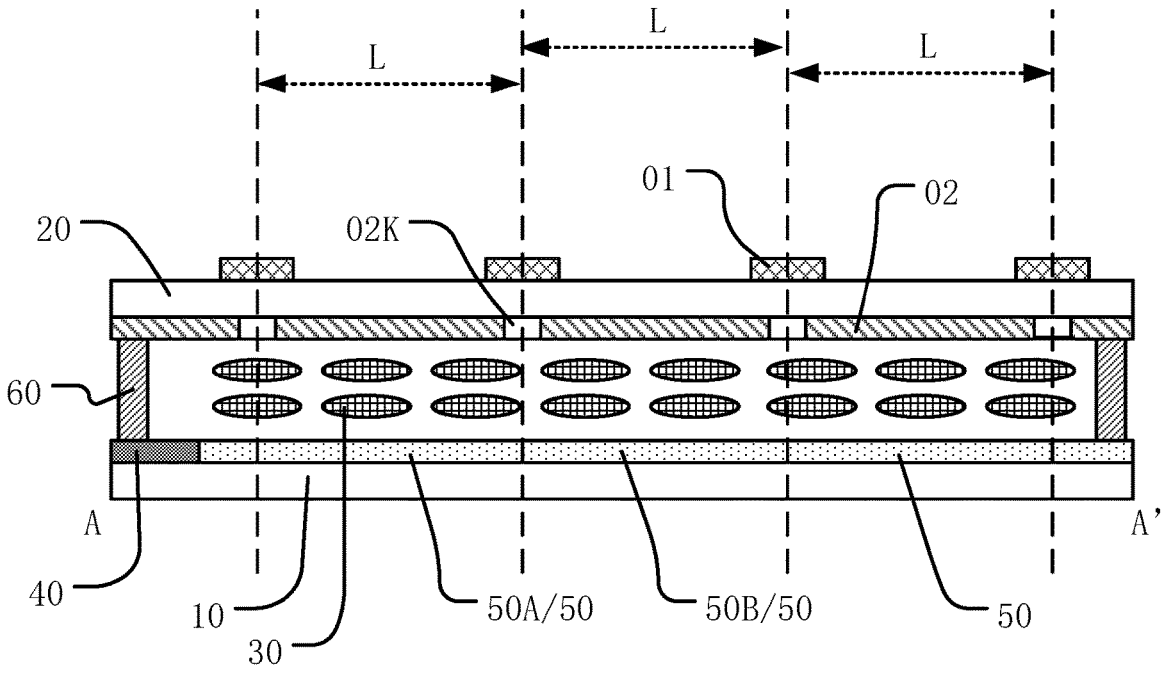
FIG. 2 illustrates a cross-sectional structural schematic along an A-A' direction in FIG. 1.
Figure 3:
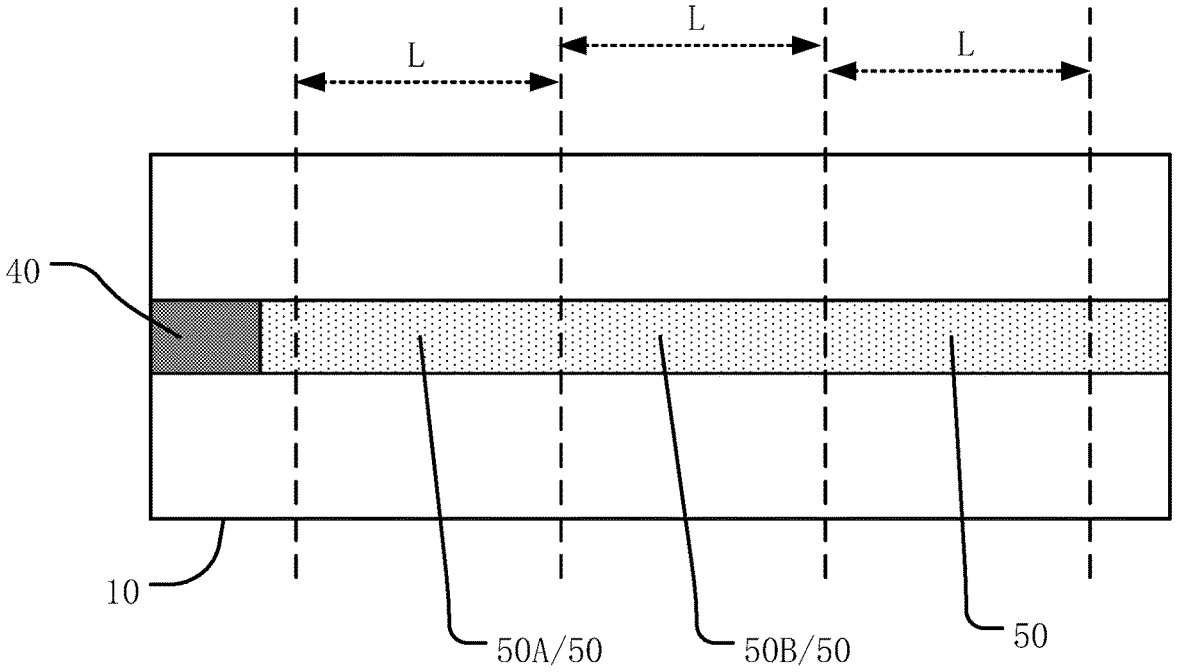
FIG. 3 illustrates a structural schematic of a surface of the first substrate facing the second substrate in FIG. 2.

Referring to FIGS. 1-2, FIG. 1 illustrates a planar structural schematic of an exemplary scanning antenna according to various embodiments of the present disclosure; and FIG. 2 illustrates a cross-sectional structural schematic along an A-A' direction in FIG. 1. It should be understood that, in order to clearly illustrate the structure of one embodiment, transparency filling may be performed in FIG. 1. A scanning antenna 000 provided by one embodiment may include the first substrate 10 and the second substrate 20 (not filled in FIG. 2) which are arranged oppositely, and a liquid crystal layer 30 between the first substrate 10 and the second substrate 20.

The scanning antenna 000 may further include a feed signal access terminal 40 and a plurality of phase shift units 50. The plurality of phase shift units 50 may be connected with each other, each phase shift unit 50 may be connected to the feed signal access terminal 40, and the electrical lengths between at least two phase shift units 50 and the feed signal access terminal 40 may be different. It can be understood that, in FIGS. 1-2 of one embodiment, the scanning antenna 000 including three phase shift units 50 may only be taken as an example for illustration and may not represent the actual number. During an implementation, the number of phase shift units 50 may be configured according to actual requirements.

For example, the scanning antenna 000 in one embodiment may be a one-dimensional wave beam scanning antenna. One-dimensional scanning antenna may indicate that the wave beam scanning direction of the antenna is only along a one-dimensional direction to achieve planar scanning. The scanning antenna 000 of one embodiment may include the first substrate 10 and the second substrate 20 which are arranged oppositely and include the liquid crystal layer 30 between the first substrate 10 and the second substrate 20. Optionally, a frame adhesive 60 may be used between the first substrate 10 and the second substrate 20 to realize the encapsulation of the liquid crystal layer 30 between the first substrate 10 and the second substrate 20. The scanning antenna 000 may also include the feed signal access terminal 40 and the plurality of phase shift units 50; and the plurality of phase shift units 50 may be connected with each other. Optionally, the plurality of phase shift units 50 may be arranged sequentially along a same direction (as shown in FIG. 1), and the plurality of phase shift units 50 may also be arranged in an array (not shown in FIG. 1). The arrangement of the plurality of phase shift units 50 may not be limited according to various embodiments of the present disclosure and may be configured according to actual requirements during an implementation. The phase shift unit 50 in one embodiment may have a wave transmission structure, for example, a microstrip line; and may be used for microwave signal transmission. Each phase shift unit 50 may be connected to the feed signal access terminal 40, and the microwave signal may be fed through the feed signal access terminal 40. Optionally, the feed signal access terminal 40 may be connected to a radio frequency connector (not shown in FIGS. 1-2). The radio frequency connector may be soldered on the first substrate 10 or on the second substrate 20, as long as it is finally connected to the phase shift unit 50 to realize the microwave signal feed.

In one embodiment, the electrical lengths between at least two phase shift units 50 and the feed signal access terminal 40 may be different. The electrical length difference may be understood as that two phase shift units 50 have different lengths to realize the electrical connection with the feed signal access terminal 40; and the distances between two phase shift units 50 and the feed signal access terminal 40 in the actual layout space may be same or different. In one embodiment shown in FIG. 1, the plurality of phase shift units 50 may include the first phase shift unit 50A and the second phase shift unit 50B. The first phase shift unit 50A and the second phase shift unit 50B may both be connected to the feed signal access terminal 40 on the left in FIG. 1. The electrical length between the first phase shift unit 50A and the feed signal access terminal 40 is L, and the electrical length between the second phase shift unit 50B and the feed signal access terminal 40 is 2L. From the actual layout space, the distance between the first phase shift unit 50A and the feed signal access terminal 40 may also be different from the distance between the second phase shift unit 50B and the feed signal access terminal 40. Optional, during an implementation, the actual spatial distance between the first phase shift unit 50A and the feed signal access terminal 40 may be configured to be same as the actual spatial distance between the second phase shift unit 50B and the feed signal access terminal 40, which may not be limited according to various embodiments of the present disclosure.

Figure 4:
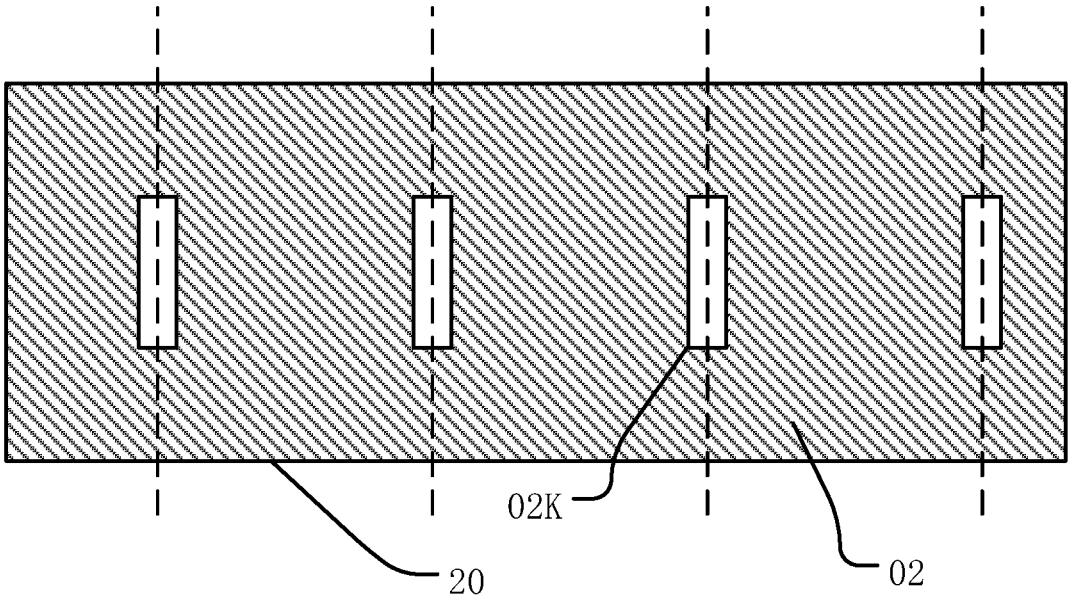
FIG. 4 illustrates a structural schematic of a surface of the second substrate facing the first substrate in FIG. 2.
Figure 5:
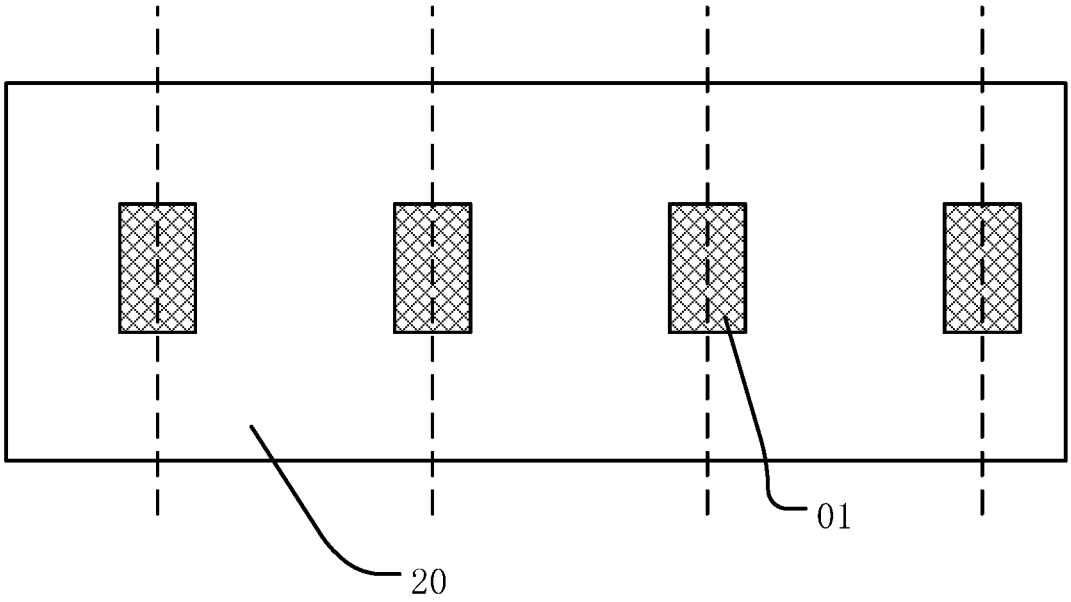
FIG. 5 illustrates a structural schematic of a surface of the second substrate away from the first substrate in FIG. 2.

Optionally, referring to FIGS. 1-5, FIG. 3 illustrates a structural schematic of a surface of the first substrate facing the second substrate in FIG. 2; FIG. 4 illustrates a structural schematic of a surface of the second substrate facing the first substrate in FIG. 2; and FIG. 5 illustrates a structural schematic of a surface of the second substrate away from the first substrate in FIG. 2. The scanning antenna of one embodiment may further include a radiator 01 and a metal ground layer 02. The radiator 01, the metal ground layer 02, and the phase shift unit 50 of the wave transmission structure may jointly complete the wave beam scanning function. As shown in FIG. 1, a plurality of radiation holes 02K may be formed on the metal ground layer 02. The microstrip line of each phase shift unit 50 may only be one straight microstrip line as an example for illustration. The radiator 01 may be a block-shaped radiation patch. The radiator 01 may be disposed on the upper surface of the second substrate 20 (that is, the surface of the second substrate 20 away from the first substrate 10); and the metal ground layer 02 may be disposed on the lower surface of the second substrate 20 (that is, the surface of the second substrate 20 facing the first substrate 10). The radiation hole 02K may correspond to the position of the radiator 01; the radiation hole 02K may couple the microwave signal transmitted on the microstrip line of each phase shift unit 50 to the radiator 01; and the radiator 01 may be mainly used to radiate the microwave signal. The phase shift unit 50 of one embodiment may be disposed on the upper surface of the first substrate 10 (that is, the surface of the first substrate 10 facing the second substrate 20), such that the liquid crystal layer 30 may be included between the phase shift unit 50 with the microstrip line and the metal ground layer 02.

In order to realize the wave beam scanning, the microwaves between adjacent phase shift units 50 may need to have a certain phase difference; and secondly, the phase difference may be realized by changing the dielectric constant of the dielectric on the microstrip line between adjacent phase shift units 50. When the liquid crystal molecules of the liquid crystal layer 30 change from a horizontal state to a vertical state under the action of a bias voltage, the dielectric constant may change from $\varepsilon 1$ to $\varepsilon 2$, where $\varepsilon 1$ is the dielectric constant of the liquid crystal molecules in the horizontal state, and $\varepsilon 2$ is the dielectric constant of the liquid crystal molecules in the vertical state. Therefore, the phase difference between adjacent phase shift units 50 may change from $\varphi 1$ to $\varphi 2$, and the wave beam pointing angle of the scanning antenna 000 may change from $\theta 1$ to $\theta 2$. In order to make the wave beam scanning angle of the scanning antenna 000 symmetrical, it is normally expected that when the liquid crystal molecules of the liquid crystal layer 30 are in an intermediate state between the horizontal state and the vertical state, the radiation wave beam angle of the scanning antenna 000 may also be in a vertical state, that is, the wave beam is in an un-scanning state. Such state may require that the phase difference between adjacent phase shift units 50 is an integral multiple of $2\pi$.

When the scanning antenna 000 provided in one embodiment performs one-dimensional wave beam scanning, the distance between adjacent phase shift units 50 is L. When the liquid crystal molecules of the liquid crystal layer 30 are in the intermediate state between the horizontal state and the vertical state, the square root of its dielectric constant is $\sqrt{\varepsilon 1}+\sqrt{\varepsilon 2}/2$, where $\varepsilon 1$ is the dielectric constant of the liquid crystal molecules in the horizontal state, and $\varepsilon 2$ is the dielectric constant of the liquid crystal molecules in the vertical state. In one embodiment, electrical lengths between at least two phase shift units 50 and the feed signal access terminal 40 may be designed to be different, such that the phase difference between two adjacent phase shift units 50 at this point may be $2m\pi$, where m is a positive integer. When the liquid crystal molecule is in the horizontal state, its dielectric constant is $\varepsilon 1$, and the phase difference between adjacent phase shift units 50 is $-\Delta\varphi$ at this point; and when the liquid crystal molecule is in the vertical state, its dielectric constant is $\varepsilon 2$, and the phase difference between adjacent phase shift units 50 at this time is $+\Delta\varphi$. Therefore, only by adjusting the bias voltage at this point, the phase difference between adjacent phase shift units 50 may be changed between $-\Delta\varphi$ and $+\Delta\varphi$, thereby realizing the wave beam scanning finally.

In one embodiment, the phase shift units 50 may be connected with each other, only one bias voltage line may be needed to provide a same bias voltage signal to all phase shift units 50, and the overall liquid crystal dielectric constant may be changed through the bias voltage signal. Since the overall liquid crystal dielectric constant in the scanning antenna 000 is changed, it is necessary to configure the length of the feed path at this point. That is, in one embodiment, although all phase shift units 50 are connected with each other, the electrical lengths between at least two phase shift units 50 and the feed signal access terminal 40 may be different, or it can be understood that the electrical lengths between all phase shift unit 50 and the feed signal access terminal 40 may be different. Therefore, the physical path lengths of the microwave signals fed into all radiators 01 may be inconsistent, showing an arithmetic relationship. That is, an initial phase difference may be provided to each microwave signal, such that the phase difference may be adjustable, thereby finally realizing the wave beam scanning.

For the liquid crystal antenna in the existing technology, the physical lengths of the microstrip lines of the phase shift units may be designed to be equal with each other, and same path lengths may be used to be connected to the feed point in parallel. Therefore, for all radiating units, the lengths of the physical paths taken by the microwave signals before reaching the radiating units may be same. In order to realize the phase shift, it is necessary to apply an independent bias voltage to each phase shift unit to change the dielectric constant of the liquid crystal medium corresponding to each phase shift unit, and finally, the phase difference of the microwave signal of each path may be realized. Required bias line network configuration may be more complicated because the bias voltage may be applied independently to each phase shift unit. Moreover, the control circuit design of the liquid crystal bias may also be more complicated and costly. In one embodiment, the scanning antenna 000 may have different electrical lengths fed from the feed signal access terminal 40 to all phase shift units 50 by configuring the feed paths. Therefore, the physical path lengths taken by the microwave signals to the radiators 01 may be inconsistent, showing an arithmetic relationship. That is, an initial phase difference may be provided to each microwave signal. The bias voltage supplied by one bias voltage line may change the overall liquid crystal dielectric constant, such that the phase difference may be adjustable, and the wave beam scanning may finally be realized. In one embodiment, it may only need to apply a same bias voltage to each phase shift unit 50 and may not need to apply a bias voltage to each phase shift unit 50 independently. Therefore, the configuration of the bias voltage line may be greatly simplified. Theoretically, only one bias voltage line may need to be disposed on the metal layer where the phase shift units 50 are located. The design difficulty and cost of the liquid crystal bias control circuit may also be greatly reduced.

For the liquid crystal antenna in the existing technology, in order to prevent the crosstalk of bias voltages between all phase shift units, the feed power division network and the phase shift units, which may not be connected with each other directly, may need to be coupled to realize microwave signal transmission. Therefore, a certain coupling loss may be inevitably between the feed power division network and the phase shift units; and such coupling manner may normally reduce the working bandwidths of the microwave signals. For the scanning antenna 000 provided in one embodiment, each phase shift unit 50 may only need to be applied with a same bias voltage, and a bias voltage may not need to be independently applied to each phase shift unit 50. Therefore, the feed signal access terminal 40 and each phase shift unit 50 may be directly connected, which can avoid the above-mentioned problems of coupling loss and working bandwidth reduction.

In the scanning antenna 000 provided in one embodiment, since the plurality of phase shift units 50 are connected with each other, only one bias voltage line may be needed to apply a bias voltage between the phase shift units 50 of the microstrip line structure and the metal ground layer 02, and complicated bias circuits may not be needed. In addition, since each phase shift unit 50 is connected to the feed signal access terminal 40, no coupling loss may be between the feed power division network and the phase shift unit, which may not only realize one-dimensional wave beam scanning, but also have desirable scanning effect. It is beneficial for reducing production costs and wiring difficulty and can be applied to scenes such as high-speed trains, subway lines, and the like.

It can be understood that FIGS. 1-5 of one embodiment may exemplarily illustrate the included structures, shapes, and configuration positions of the phase shift unit 50, the radiator 01, and the metal ground layer 02, which may not be limited according to various embodiments of the present disclosure. The structures may also be other configuration structures that can realize the scanning function, which may not be limited according to various embodiments of the present disclosure as long as one-dimensional wave beam scanning can be realized. In FIGS. 1-5 of one embodiment, the feed signal access terminal 40 on the left side of the phase shift unit 50 may be connected to a radio frequency connector (not shown in FIGS. 1-5), and the radio frequency connector may be connected to the microwave signal transmitter to directly provide the microwave signal for each phase shift unit 50. Optionally, the feed signal access terminal 40 may also be on the side of the second substrate 20, and then the high-frequency signal may be coupled to the phase shift unit 50 of the microstrip line structure of the first substrate 10 by a coupling manner.

Figure 6:
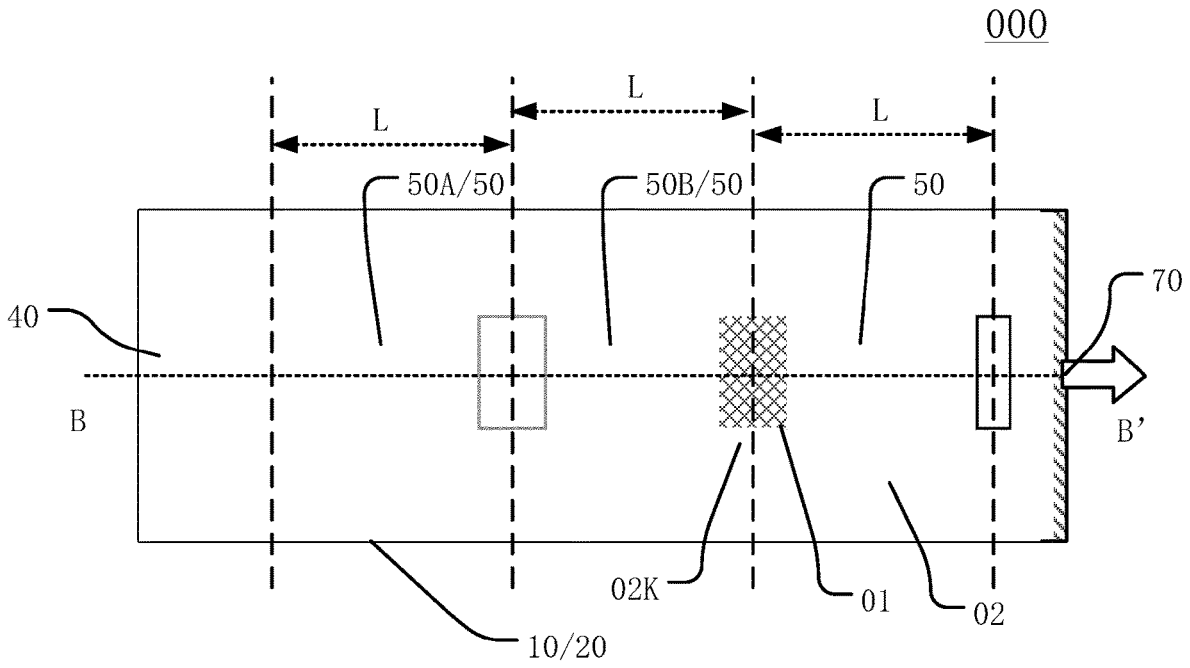
FIG. 6 illustrates another planar structural schematic of an exemplary scanning antenna according to various embodiments of the present disclosure.
Figure 7:
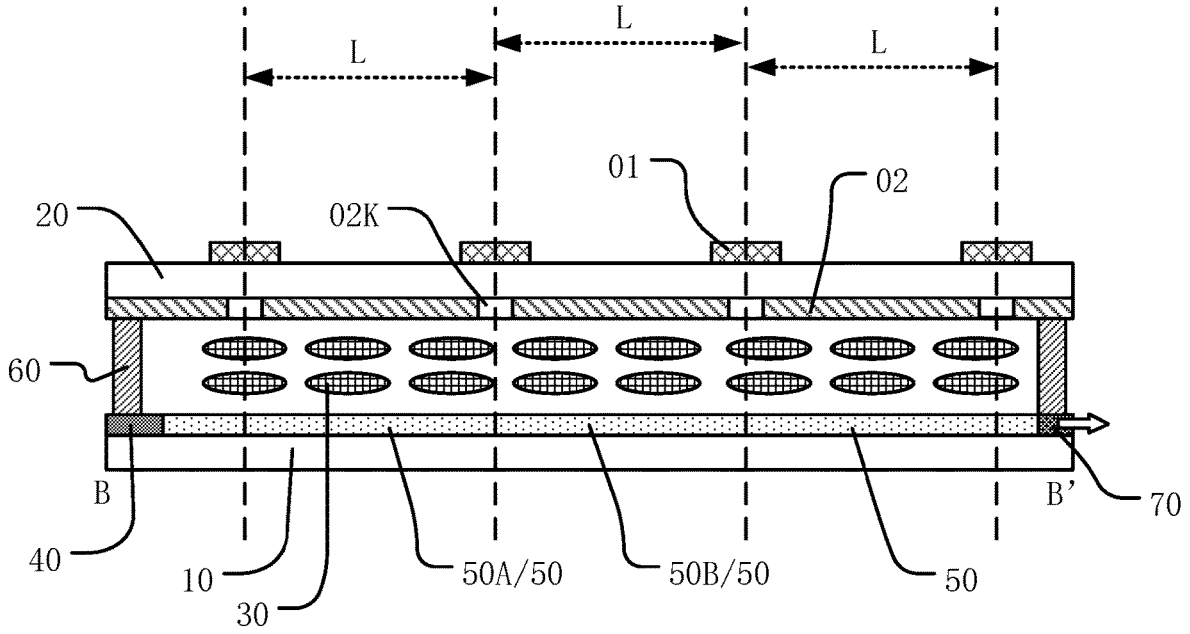
FIG. 7 illustrates a cross-sectional structural schematic along a B-B' direction in FIG. 6.

In some optional embodiments, referring to FIGS. 6-7, FIG. 6 illustrates another planar structural schematic of an exemplary scanning antenna according to various embodiments of the present disclosure; and FIG. 7 illustrates a cross-sectional structural schematic along a B-B' direction in FIG. 6. It should be understood that, in order to clearly illustrate the structure of one embodiment, transparency filling may be performed in FIG. 6. In one embodiment, the scanning antenna 000 may further include a load 70, one end of the plurality of phase shift units 50 which are connected with each other may be connected to the feed signal access terminal 40, and the other end of the plurality of phase shift units 50 which are connected with each other may be connected to the load 70.

In one embodiment, it describes that the plurality of phase shift units 50 connected with each other may be also connected to the load 70. Optionally, the input terminals of the plurality of phase shift units 50 which are connected with each other may be connected to the feed signal access terminal 40, and the output terminals of the plurality of phase shift units 50 which are connected with each other may be connected to the load 70. The load 70 may be used as a wave-absorbing device structure. Matching the load 70 with the output terminals of the plurality of phase shift units 50 which are connected with each other may completely absorb the microwaves reaching the tail-ends of the phase shift units 50 (microstrip line structures), without being reflected back to previous phase shift units 50 (microstrip line structures). The load 70 may be a matched wave absorbing material or a matched circuit structure, which may not be limited in one embodiment.

Figure 8:
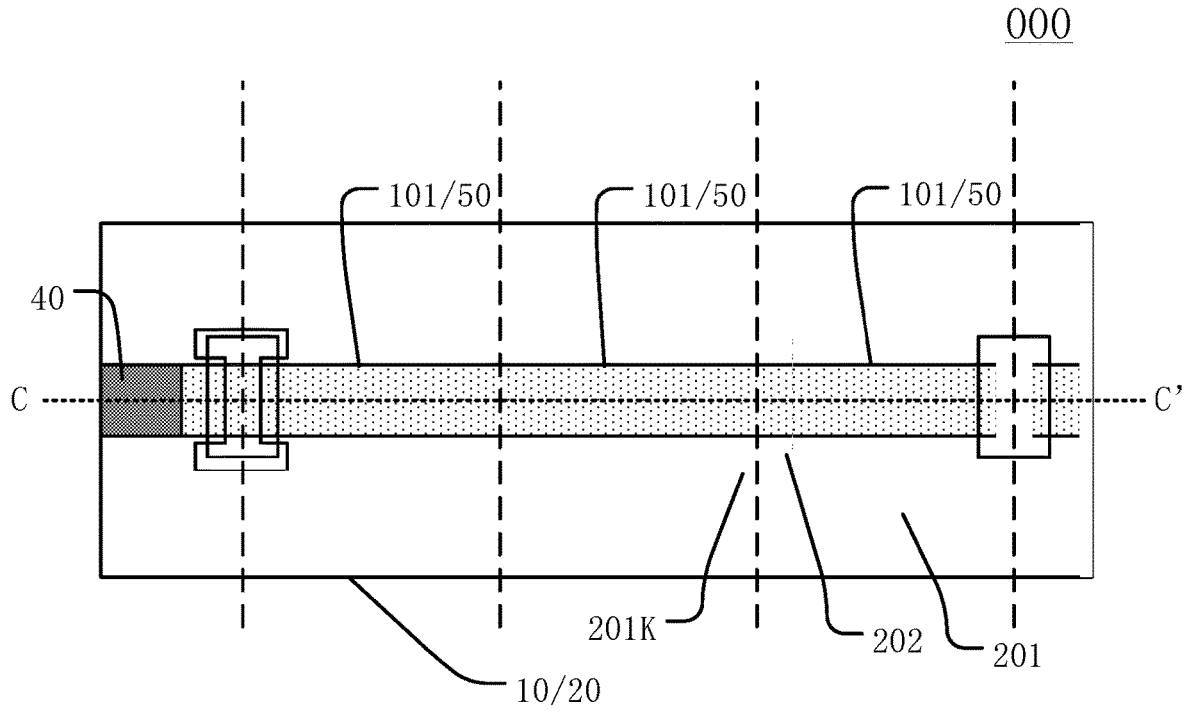
FIG. 8 illustrates another planar structural schematic of an exemplary scanning antenna according to various embodiments of the present disclosure.
Figure 9:
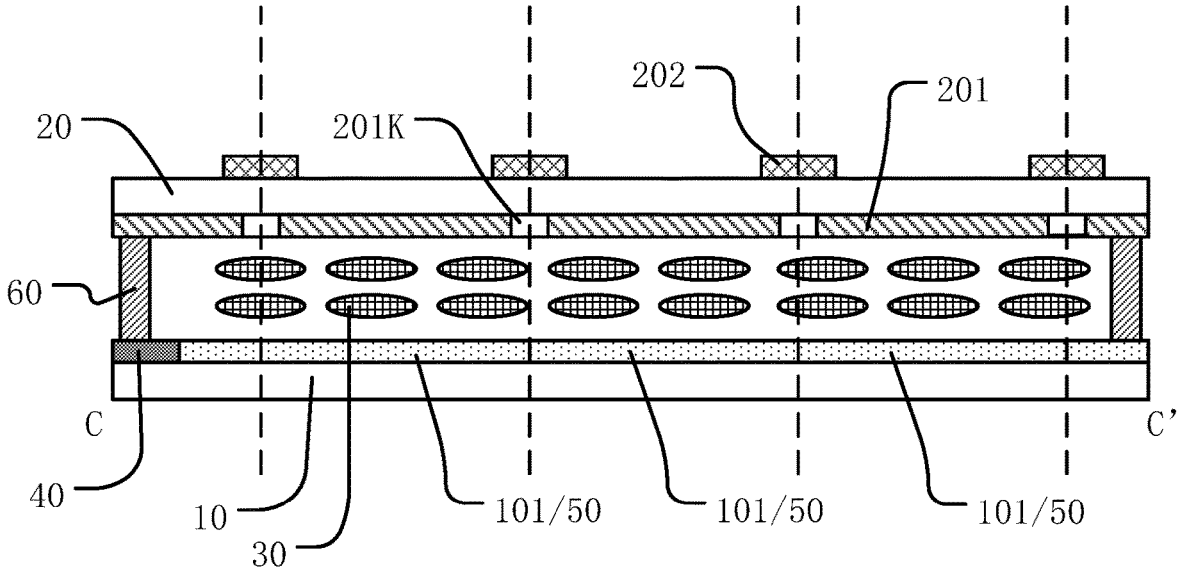
FIG. 9 illustrates a cross-sectional structural schematic along a C-C' direction in FIG. 8.
Figure 10:
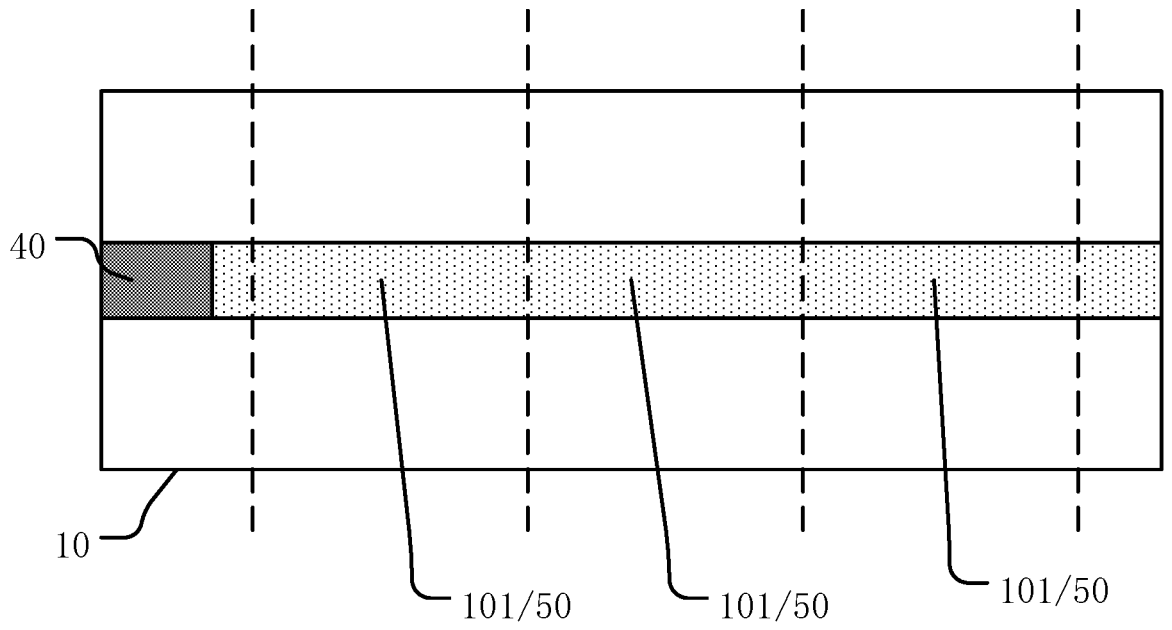
FIG. 10 illustrates a structural schematic of a surface of the first substrate facing the second substrate in FIG. 9.
Figure 11:
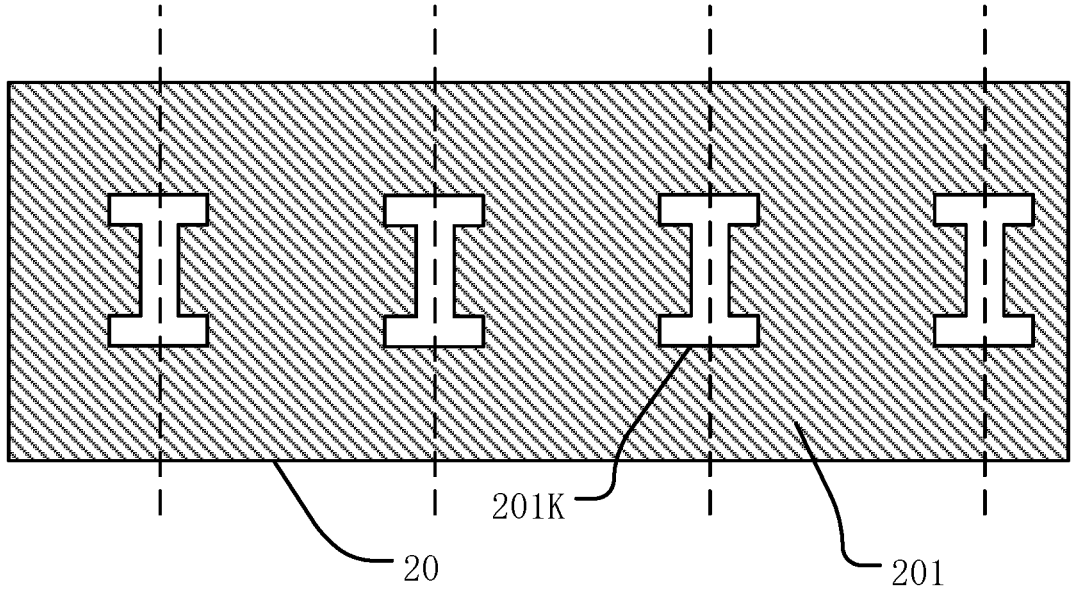
FIG. 11 illustrates a structural schematic of a surface of the second substrate facing the first substrate in FIG. 9.
Figure 12:
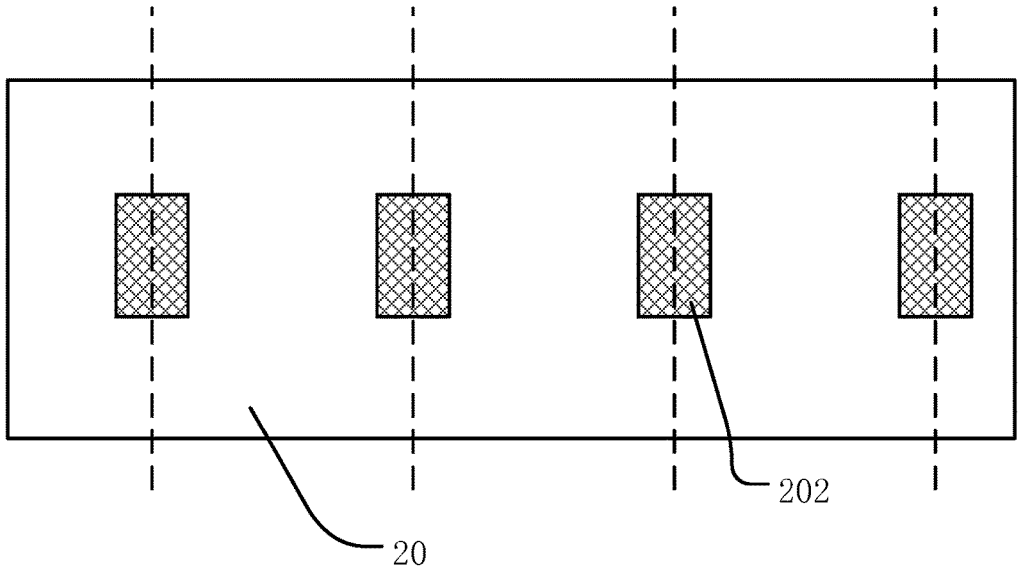
FIG. 12 illustrates a structural schematic of a surface of the second substrate away from the first substrate in FIG. 9.

In some optional embodiments, referring to FIGS. 8-12, FIG. 8 illustrates another planar structural schematic of an exemplary scanning antenna according to various embodiments of the present disclosure; FIG. 9 illustrates a cross-sectional structural schematic along a C-C' direction in FIG. 8 (it should be understood that, in order to clearly illustrate the structure of one embodiment, transparency filling may be performed in FIG. 8); FIG. 10 illustrates a structural schematic of a surface of the first substrate facing the second substrate in FIG. 9; FIG. 11 illustrates a structural schematic of a surface of the second substrate facing the first substrate in FIG. 9; and FIG. 12 illustrates a structural schematic of a surface of the second substrate away from the first substrate in FIG. 9. In one embodiment, the phase shift unit 50 may include the first conductive portion 101; and the first conductive portion 101 may be disposed on the side of the first substrate 10 facing the second substrate 20.

The side of the second substrate 20 facing the first substrate 10 may include the second conductive portion 201; and the second conductive portion 201 may include a plurality of through holes 201K.

The side of the second substrate 20 away from the first substrate 10 may include a plurality of third conductive portions 202. The orthographic projection of the third conductive portion 202 on the second substrate 20 may overlap the orthographic projection of the through hole 201K at the second substrate 20. The orthographic projection of the first conductive portion 101 on the second substrate 20 may be located between the orthographic projections of two adjacent third conductive portions 202 on the second substrate 20.

The feed signal received by the feed signal access terminal 40 may be transmitted to the first conductive portion 101; and the first conductive portion 101 may couple the signal to the third conductive portion 202 through the through hole 201K of the second conductive portion 201.

Optionally, the first conductive portion 101 may be a microstrip line for wave transmission function; the second conductive portion 201 may be an entire surface structure and connected to a ground signal; and the third conductive portion 202 may be a block-shaped structure.

In one embodiment, it describes that the scanning antenna 000 may be a three-layer metal conductive structure arranged on the first substrate 10 and the second substrate 20. The first substrate 10 may be disposed at the side of the first substrate 10 facing the second substrate 20, and the phase shift unit 50 may include the first conductive portion 101 of the microstrip line structure. The side of the second substrate 20 facing the first substrate 10 may include the second conductive portion 201 for grounding signals. The second conductive portion 201 may be a structure in which the entire surface is disposed on the surface of the second substrate 20. The plurality of through holes 201K may be formed on the second conductive portion 201, and the through holes 201K may be used for radiating signals. The side of the second substrate 20 away from the first substrate 10 may include the plurality of block-shaped third conductive portions 202. The third conductive portions 202 may be used as radiation patches to radiate microwave signals. The arrangement positions of the third conductive portions 202 may correspond to the arrangement positions of the through holes 201K. That is, the orthographic projection of the third conductive portion 202 on the second substrate 20 may overlap the orthographic projection of the through hole 201K at the second substrate 2. The orthographic projection of the first conductive portion 101 of the microstrip line structure on the second substrate 20 may be between the orthographic projections of two adjacent third conductive portions 202 on the second substrate 20 to form one phase shift unit 50. For the scanning antenna 000 configured in one embodiment, similarly, only one bias voltage line may be needed to apply a bias voltage between the first conductive portion 101 and the second conductive portion 201 of the microstrip line structure, and complicated bias circuits may not be needed. In addition, since each phase shift unit 50 is connected to the feed signal access terminal 40, no coupling loss may be between the feed power division network and the phase shift unit, which may not only realize one-dimensional wave beam scanning, but also have desirable scanning effect. It is beneficial for reducing production costs and wiring difficulty. Moreover, since the third conductive portion 202 as the radiation patch is located on the side of the second substrate 20 away from the first substrate 10, no liquid crystal material may be under the third conductive portion 202. When the dielectric constant of the liquid crystal is changed by the bias voltage, the radiation performance of the third conductive portion 202 may not be greatly affected, which is beneficial for improving the scanning performance.

In some optional embodiments, referring to FIGS. 1-5 and 8-12, the shape of the orthographic projection of the through hole 201K formed at the second conductive portion 201 on the second substrate 20 may include one of a strip shape, an H shape, and/or any other suitable shapes.

In one embodiment, it describes that the shape of the orthographic projection of the through hole 201K for coupling the microwave signal transmitted on the microstrip line of each phase shift unit 50 to the radiation patch on the second substrate 20 may be a strip shape as shown in FIGS. 1 and 4 and may also be an H shape as shown in FIG. 8 and FIG. 11. In one embodiment, the shape of the orthographic projection of the through hole 201K at the second substrate 20 is configured to be an H shape, such that it may easily adjust and improve the efficiency of the first conductive portion 101 of the microstrip line to transmit microwave signals to the third conductive portion 202 through the through hole 201K at the second conductive portion 201, which may be beneficial for improving the scanning performance.

Figure 13:
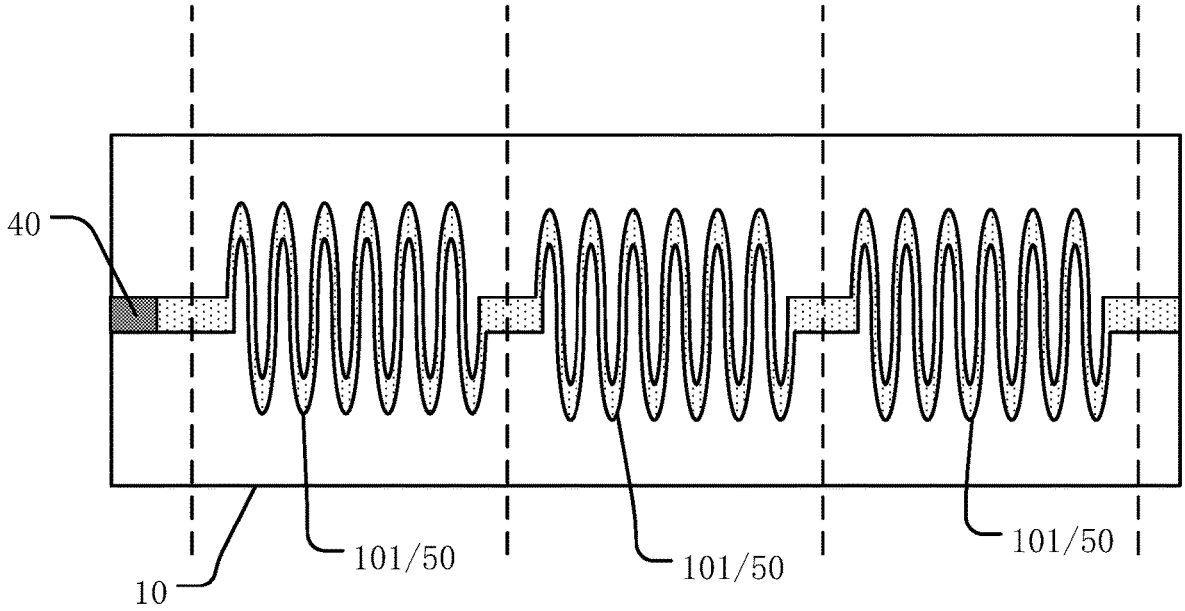
FIG. 13 illustrates another structural schematic of a surface of the first substrate facing the second substrate in FIG. 9.
Figure 14:
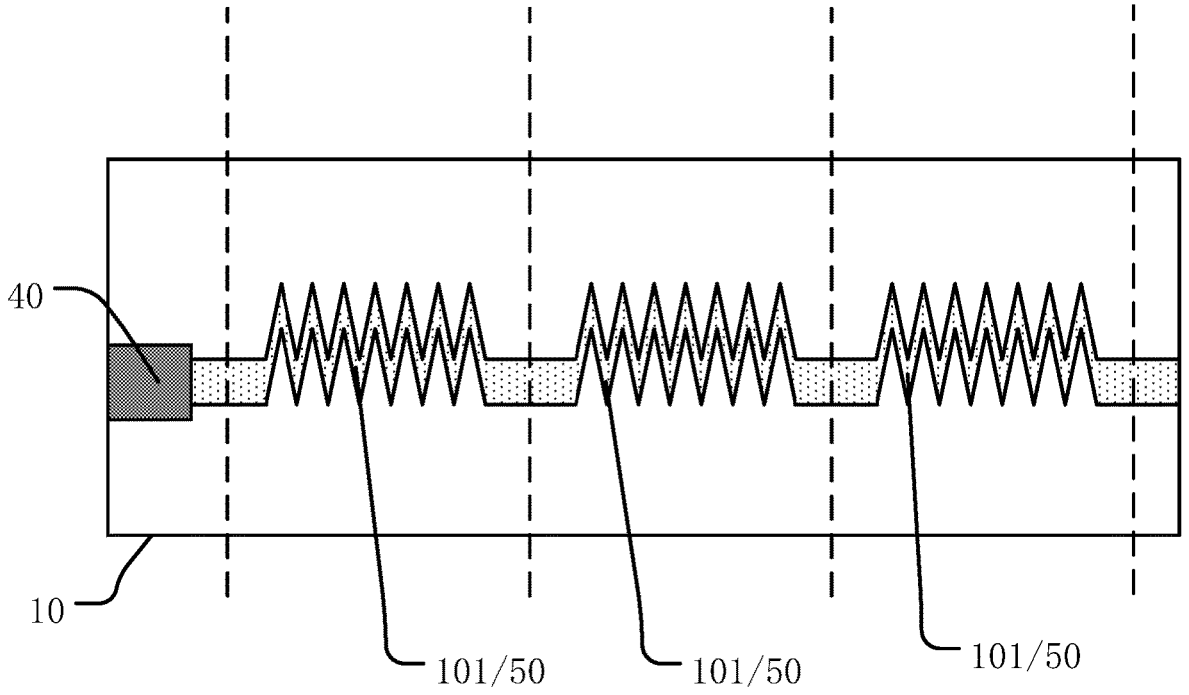
FIG. 14 illustrates another structural schematic of a surface of the first substrate facing the second substrate in FIG. 9.

In some optional embodiments, referring to FIGS. 8-14, FIG. 13 illustrates another structural schematic of a surface of the first substrate facing the second substrate in FIG. 9; and FIG. 14 illustrates another structural schematic of a surface of the first substrate facing the second substrate in FIG. 9. In one embodiment, the first conductive portion 101 may include one of a linear line shape, a curved line shape, a zigzag line shape, and/or any other suitable shapes.

In one embodiment, it further describes that the shape of each first conductive portion 101 used as the microstrip line may be a linear line shape as shown in FIG. 10, a curved line shape as shown in FIG. 13, or a zigzag line shape as shown in FIG. 14, which may not be limited according to various embodiments of the present disclosure. It may only need to satisfy that the electrical lengths feed from the feed signal access terminal 40 to the first conductive portions 101 of the phase shift units 50 are different. Therefore, the physical path lengths of the microwave signals that reach the third conductive portions 202 of the radiation patches may be inconsistent, showing an arithmetic relationship. That is, an initial phase difference may be provided to each microwave signal. Then, only the bias voltage supplied by a bias voltage line may change the overall liquid crystal dielectric constant, such that the phase difference may be adjusted and the wave beam scanning of the scanning antenna 000 in one embodiment may be realized finally. It can be understood that the included shapes of the first conductive portions 101 may only be shown in one embodiment, which may not be limited according to various embodiments of the present disclosure. In an implementation, the shapes of the first conductive portions 101 used as the microstrip lines may also include slow-wave-like structures such as defective ground structures, composite left-right-handed structures and the like, and include other shapes, which may not be described in detail in one embodiment.

Figure 15:
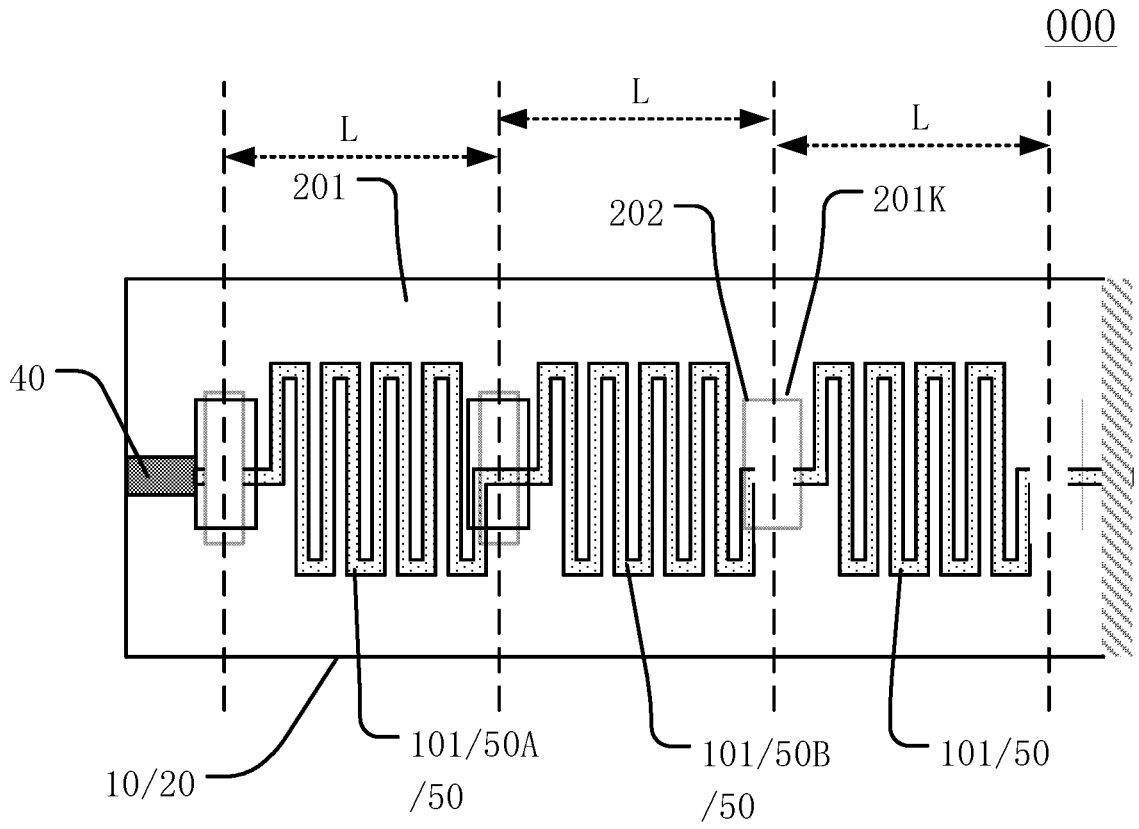
FIG. 15 illustrates another planar structural schematic of an exemplary scanning antenna according to various embodiments of the present disclosure.
Figure 16:
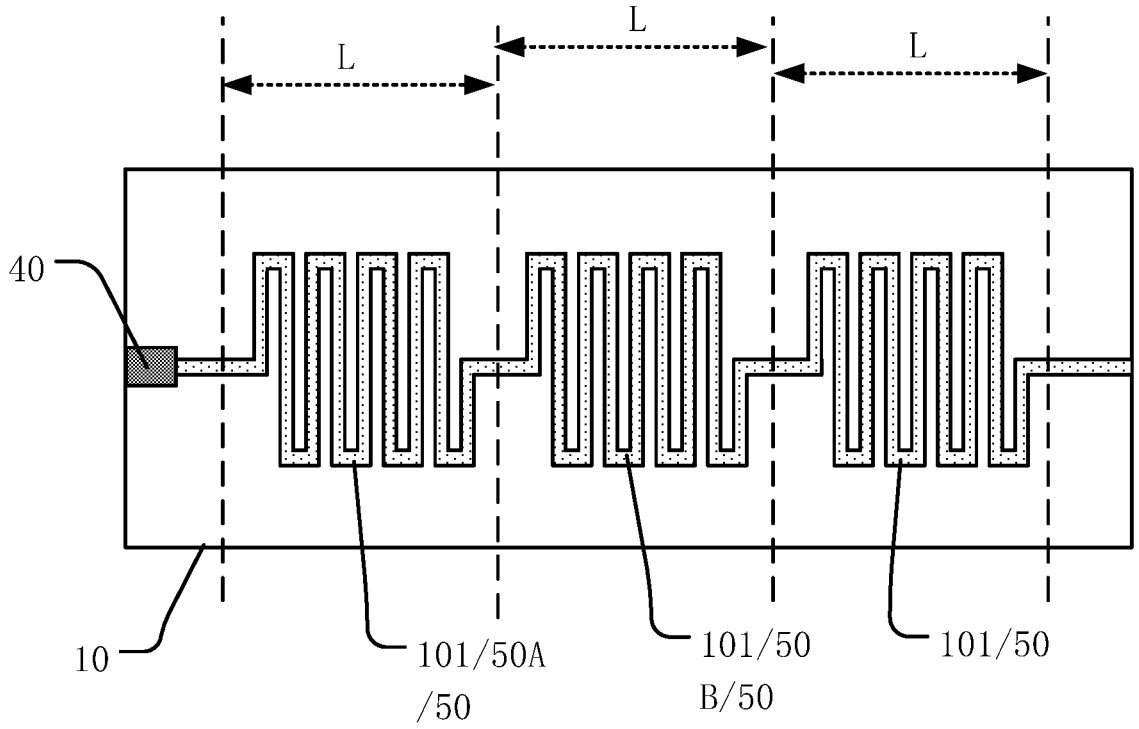
FIG. 16 illustrates a structural schematic of a surface of the first substrate facing the second substrate in FIG. 15.

Optionally, referring to FIGS. 15-16, FIG. 15 illustrates another planar structural schematic of an exemplary scanning antenna according to various embodiments of the present disclosure (it should be understood that, in order to clearly illustrate the structure of one embodiment, transparency filling may be performed in FIG. 15); and FIG. 16 illustrates a structural schematic of a surface of the first substrate facing the second substrate in FIG. 15. In one embodiment, the first conductive portion 101 may have a serpentine bending shape.

In one embodiment, the first conductive portion 101 of a zigzag line shape, a curved line shape, or a serpentine bending shape may be configured, such that it realizes that the part of the first conductive portion 101 used as the microstrip line may be increased. The formula of the phase shift is $$\Delta\varphi = \frac{2\pi}{\lambda 0} \times L \times \Delta\sqrt{\varepsilon_e},$$

where λ0 is the wavelength of the microwave signal in vacuum which can be understood as a constant; L is the physical length of the microstrip line between adjacent phase shift units 50; and εe is the effective dielectric constant which is related to the state of the liquid crystal. The dielectric change range of the liquid crystal molecules in the liquid crystal layer 30 of one embodiment is fixed, that is, the change magnitude of εe is also fixed. Therefore, to achieve a relatively large phase shift magnitude, the physical length L of the microstrip line between adjacent phase shift units 50 may be increased. Therefore, configuring the first conductive portion 101 into a zigzag line shape, a curved line shape, or a serpentine bending shape may further increase the length of the microstrip line between adjacent phase shift units 50, thereby further realizing a relatively large phase shift magnitude, which is beneficial for improving the scanning effect of the scanning antenna 000.

In some optional embodiments, referring to FIGS. 15-16, in one embodiment, along the direction in parallel with the plane where the first substrate 10 is located, the plurality of first conductive portions 101 may be arranged sequentially along a same direction and connected with each other; and the electrical lengths of two adjacent first conductive portions 101 may be equal to each other.

In one embodiment, it describes that the electrical lengths between at least two phase shift units 50 (first conductive portions 101) and the feed signal access terminal 40 may be different; and when the plurality of phase shift units 50 are connected with each other, along the direction in parallel with the plane where the first substrate 10 is located, the plurality of first conductive portions 101 may be arranged sequentially along a same direction and connected with each other in series. At this point, the electrical lengths between any two adjacent first conductive portions 101, which are electrically connected to the feed signal access terminal 40 respectively, and the feed signal access terminal 40 may be different, and the actual spatial distances between two first conductive portions 101 and the feed signal access terminal 40 may also be different. As shown in FIGS. 15 and 16, two adjacent phase shift units 50 may include the first phase shift unit 50A and the second phase shift unit 50B. The first phase shift unit 50A and the second phase shift unit 50B may both be connected to the feed signal access terminal 40 on the left in FIG. 15 and FIG. 16. The electrical length between the first phase shift unit 50A and the feed signal access terminal 40 is L; and the electrical length between the second phase shift unit 50B and the feed signal access terminal 40 is 2L. From the actual layout space, the physical distance between the first phase shift unit 50A and the feed signal access terminal 40 may also be different from the physical distance between the second phase shift unit 50B and the feed signal access terminal 40.

In one embodiment, the electrical lengths of two adjacent phase shift units 50 (first conductive portions 101) may also be equal to each other. Electrical lengths of the electrical connections respectively between any two adjacent first conductive portions 101 and the feed signal access terminal 40 may be different. That is, in FIGS. 15 and 16, the electrical length from the first phase shift unit 50A to the feed signal access terminal 40 may be different from the electrical length from the second phase shift unit 50B to the feed signal access terminal 40; and the physical distance between the first phase shift unit 50A and the feed signal access terminal 40 may also be different from the physical path between the second phase shift unit 50B and the feed signal access terminal 40. However, the electrical lengths of two adjacent first conductive portions 101 may be configured to be equal to each other to ensure the same phase difference during wave beam scanning, thereby further improving the scanning effect.

Figure 17:
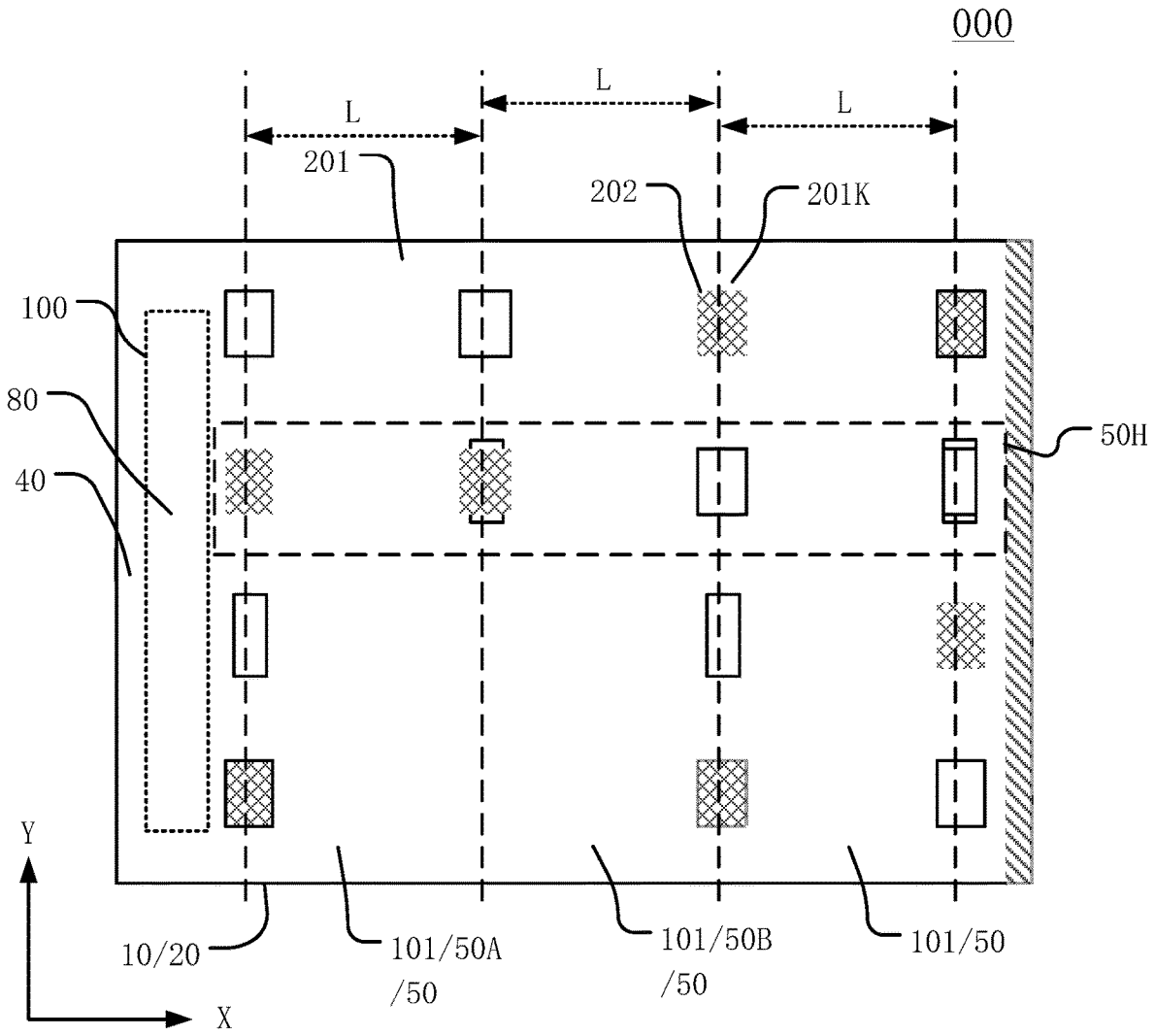
FIG. 17 illustrates another planar structural schematic of an exemplary scanning antenna according to various embodiments of the present disclosure.
Figure 18:
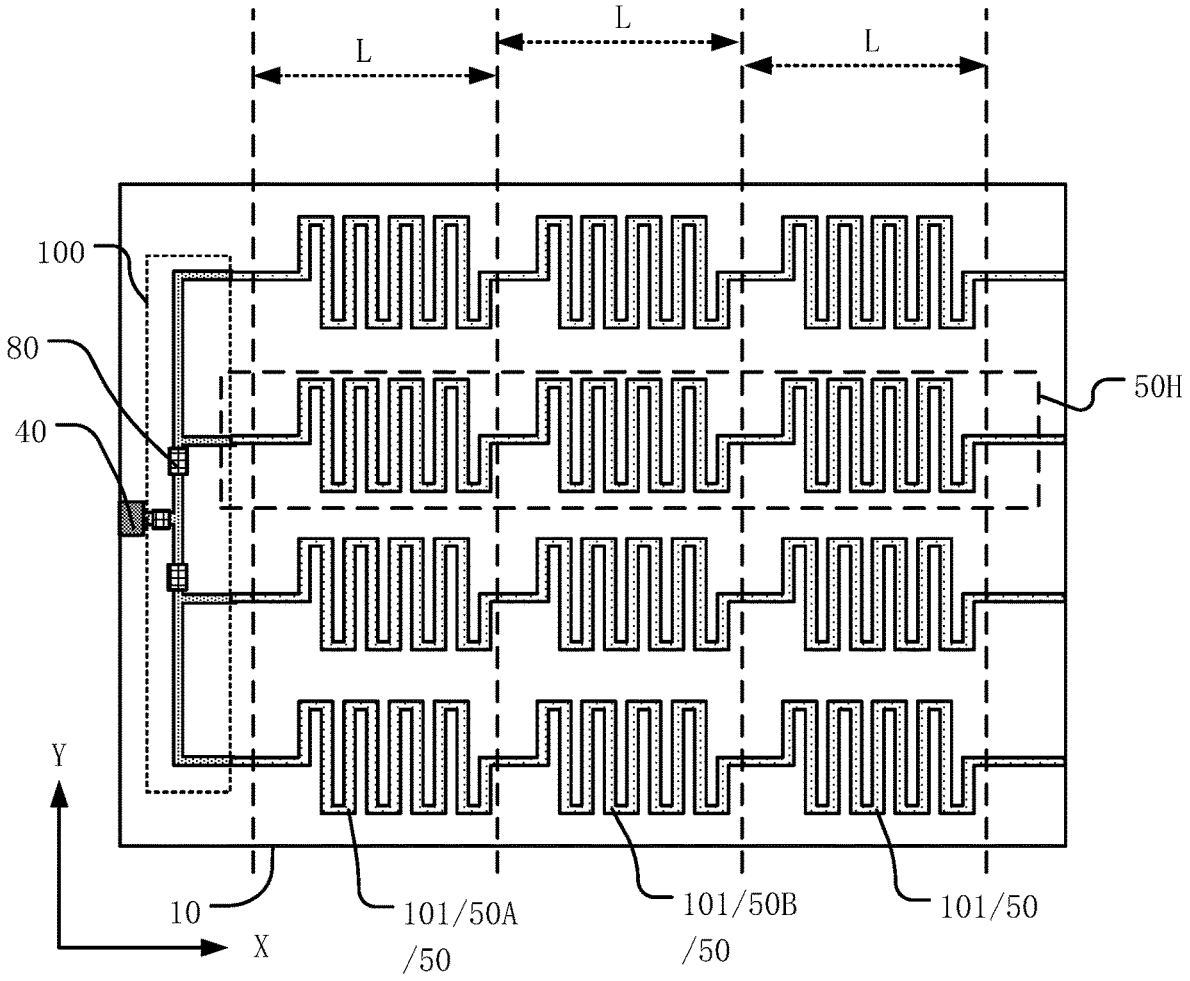
FIG. 18 illustrates a structural schematic of a surface of the first substrate facing the second substrate in FIG. 17.

In some optional embodiments, referring to FIGS. 17-18, FIG. 17 illustrates another planar structural schematic of an exemplary scanning antenna according to various embodiments of the present disclosure (it should be understood that, in order to clearly illustrate the structure of one embodiment, transparency filling may be performed in FIG. 17); and FIG. 18 illustrates a structural schematic of a surface of the first substrate facing the second substrate in FIG. 17. In one embodiment, the scanning antenna 000 may include a plurality of phase shift unit rows 50H. The plurality of first conductive portions 101 may be arranged sequentially along the first direction X and connected with each other to form one phase shift unit row 50H. The plurality of phase shift unit rows 50H may be sequentially arranged along the second direction Y. Along the direction in parallel with the plane of the first substrate 10, the first direction X may intersect the second direction Y. Optionally, in one embodiment, along the direction in parallel with the plane where the first substrate 10 is located, the first direction X and the second direction Y may be perpendicular to each other as an example for illustration.

One end of each phase shift unit row 50H may be connected to the feed signal access terminal 40.

In one embodiment, it describes that all phase shift units 50 in the scanning antenna 000 may also be a series-parallel hybrid structure for feeding the microwave signals. That is, the scanning antenna 000 may include the plurality of phase shift unit rows 50H; the plurality of first conductive portions 101 in each phase shift unit row 50H may be arranged sequentially along the first direction X and connected with each other to form one phase shift unit row 50H; the plurality of phase shift unit rows 50H may be sequentially arranged along the second direction Y; and finally, one end of each phase shift unit row 50H may be connected to the feed signal access terminal 40 on the left side in FIGS. 17 and 18. The gain of the scanning antenna 000 is proportional to the overall number of radiating units. In one embodiment, all phase shift units 50 in the scanning antenna 000 may be designed as a surface array structure, that is, all phase shift units 50 may be a series-parallel hybrid design. The number of phase shift units 50 of the surface array structure may be more than that of the linear array structure, such that the surface array structure may have relatively large gain. In one embodiment, in order to increase the antenna gain, the antenna may be designed in the form of a surface array, and a power divider 100 (to realize one-to-multiple signal transmission function) may be used at the feed signal access terminal 40 to distribute the microwave signals to the phase shift units 50 of each phase shift unit row 50H. Therefore, while one-dimensional beam scanning can be realized, the gain of the entire scanning antenna 000 may also be improved.

Optionally, in FIG. 17 and FIG. 18 of one embodiment, the feed signal access terminal 40 may be only at the middle position of four phase shift unit rows 50H along the second direction Y. That is, four phase shift unit rows 50H may be symmetrical on two sides of the feed signal access terminal 40. Therefore, the phase difference between different phase shift unit rows 50H along the second direction Y may be reduced, and the one-dimensional beam scanning along the first direction X may be better realized.

Furthermore, optionally, as shown in FIG. 17 and FIG. 18, when the feed signal access terminal 40 of one embodiment is connected to each phase shift unit row 50H, one adjustment load 80 may be added between the feed signal access terminal 40 and a part of the phase shift unit rows 50H to adjust the electrical lengths from the phase shift unit rows 50H to the feed signal access terminal 40. By setting the magnitude of the adjustment load 80, the phase differences between different phase shift unit rows 50H along the second direction Y may be further reduced, and the effect of scanning the antenna may be increased.

It can be understood that, in one embodiment, each phase shift unit row 50H including three connected first conductive portions 101 and the scanning antenna 000 including four phase shift unit rows 50H arranged sequentially along the second direction Y may only be taken as an example for illustration, where the numbers may not be limited in the present disclosure. During an implementation, the numbers of the phase shift unit rows 50H and the first conductive portions 101 in the scanning antenna 000 may be selected and configured according to actual requirements, which may not be described in detail in one embodiment. In one embodiment, each first conductive portion 101 may be a serpentine bending shape as an example for illustration. The first conductive portion 101 may not be limited to such shape and may also be a microstrip line structure of another shape, which may not be described in detail in one embodiment.

Figure 19:
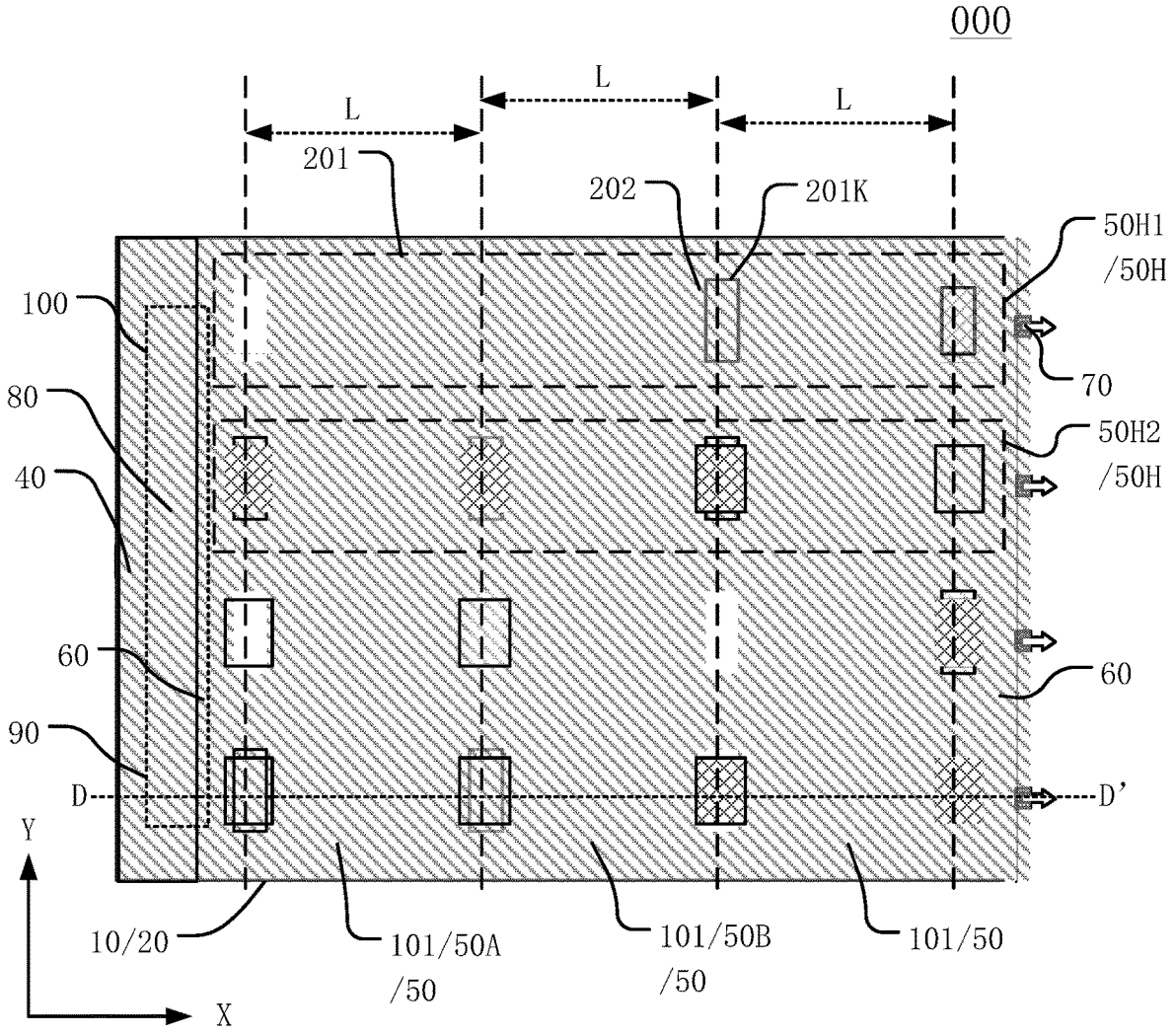
FIG. 19 illustrates another planar structural schematic of an exemplary scanning antenna according to various embodiments of the present disclosure.
Figure 20:
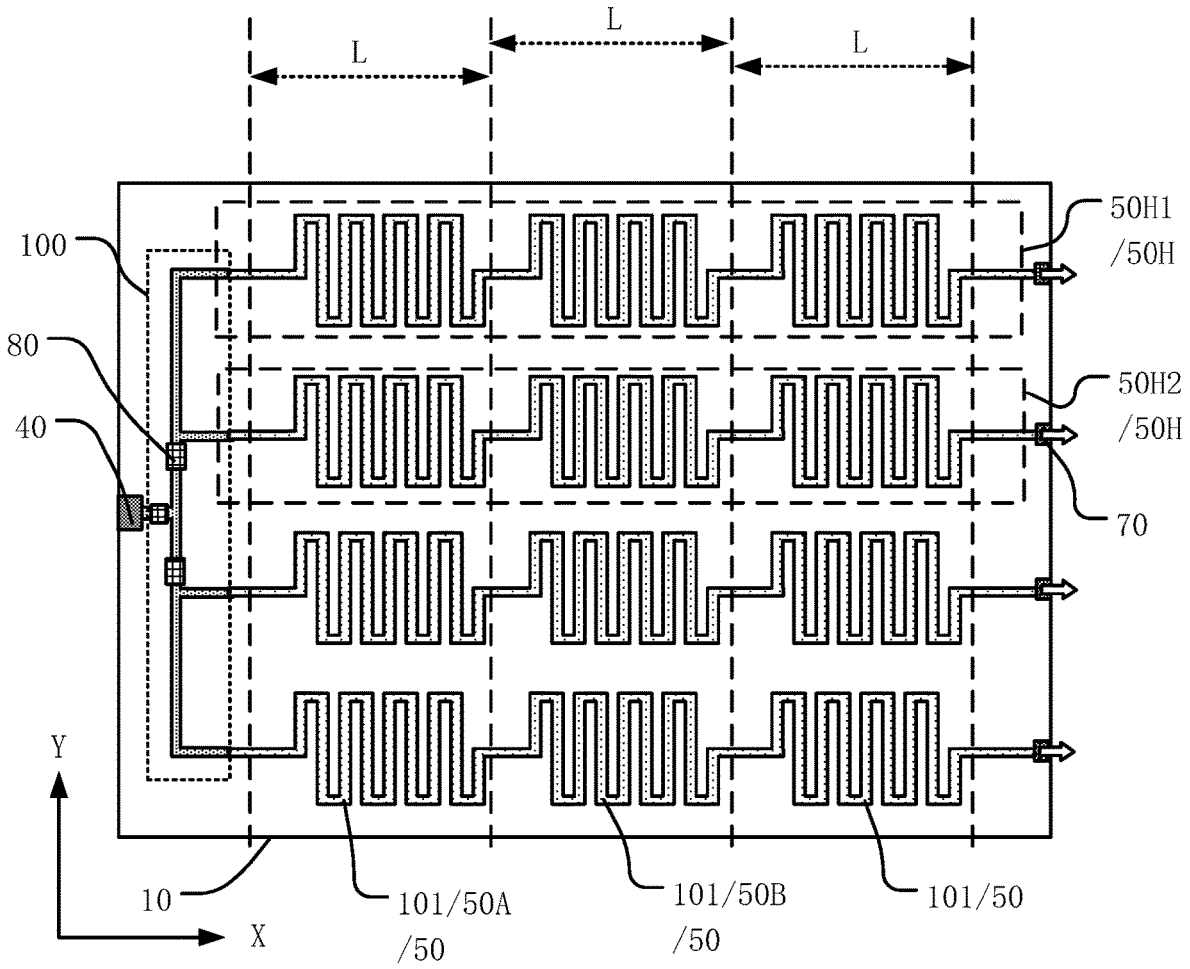
FIG. 20 illustrates a structural schematic of a surface of the first substrate facing the second substrate in FIG. 19.
Figure 21:
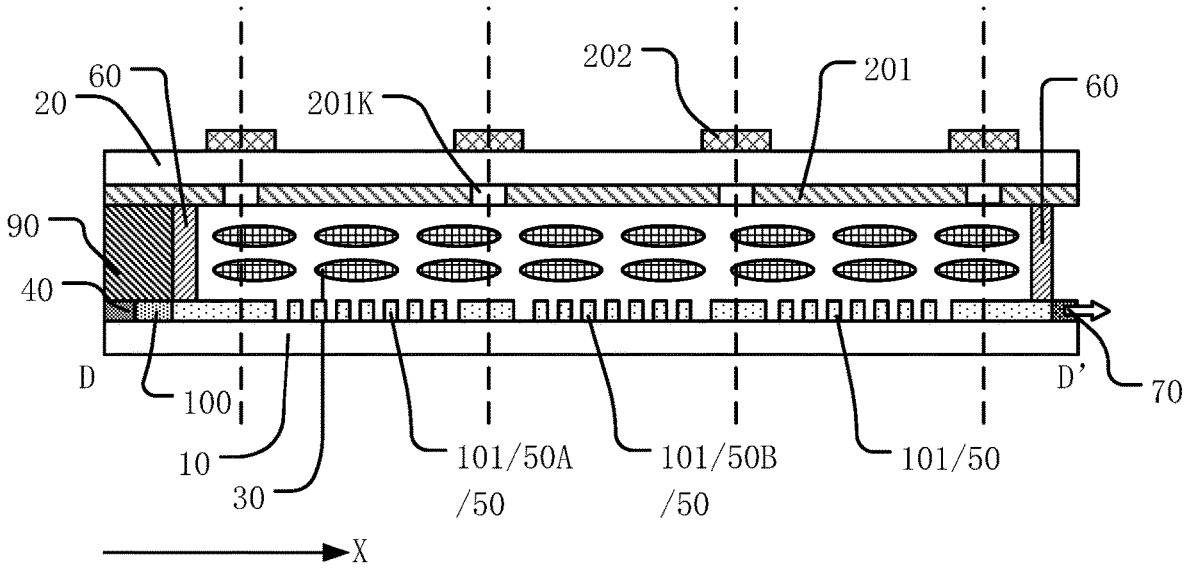
FIG. 21 illustrates a cross-sectional structural schematic along a D-D' direction in FIG. 19.

In some optional embodiments, referring to FIGS. 19-21, FIG. 19 illustrates another planar structural schematic of an exemplary scanning antenna according to various embodiments of the present disclosure (it should be understood that, in order to clearly illustrate the structure of one embodiment, transparency filling may be performed in FIG. 19); FIG. 20 illustrates a structural schematic of a surface of the first substrate facing the second substrate in FIG. 19; and FIG. 21 illustrates a cross-sectional structural schematic along a D-D' direction in FIG. 19. In one embodiment, a dielectric layer 90 may be further included between the first substrate 10 and the second substrate 20. The orthographic projection of the dielectric layer 90 on the first substrate 10 may overlap the orthographic projection of the feed signal access terminal 40 on the first substrate 10. The orthographic projection of the feed signal access terminal 40 on the first substrate 10 may not overlap the orthographic projection of the liquid crystal layer 30 on the first substrate 10.

The dielectric layer 90 may include air and/or a solid dielectric.

In one embodiment, it describes that the electrical lengths between all phase shift unit rows 50H and the feed signal access terminal 40 may be different when being electrically connected with each other. For example, in FIGS. 19 and 20, the electrical length from one phase shift unit row 50H1 to the feed signal access terminal 40 may be greater than the electrical length from another phase shift unit row 50H2 to the feed signal access terminal 40, and different electrical lengths may be likely to cause phase difference. Therefore, in order to prevent the phase difference between all phase shift unit rows 50H having a parallel relationship, the dielectric layer 90 may be disposed between the first substrate 10 and the second substrate 20 and at the position of the feed signal access terminal 40 in one embodiment. That is, the orthographic projection of the dielectric layer 90 on the first substrate 10 may overlap the orthographic projection of the feed signal access terminal 40 on the first substrate 10. Optionally, the position of the power divider 100 (to realize one-to-multiple signal transmission function) where the feed signal access terminal 40 is connected to all phase shift unit rows 50H may also include the dielectric layer 90. The orthographic projection of the feed signal access terminal 40 on the first substrate 10 may not overlap the orthographic projection of the liquid crystal layer 30 on the first substrate 10. The material of the dielectric layer 90 may be a low-loss material, such as air, or a solid dielectric, or may also be a mixed material of air and a solid dielectric, which may not be limited in one embodiment, as long as the dielectric layer 90 is a low-loss material. Optionally, the material of the dielectric layer 90 may not be the material of the frame adhesive 60 because the material of the frame adhesive 60 has a large signal loss. Therefore, the position of the power divider 100 where the feed signal access terminal 40 is connected to all phase shift unit rows 50H should avoid of disposing the frame adhesive 60, which may be beneficial for enhancing the antenna gain and avoiding signal loss. In one embodiment, the dielectric layer 90 may be disposed in the region corresponding to the feed signal access terminal 40 and the power divider 100, such that the liquid crystal molecules of the liquid crystal layer 30 may avoid appearing in such region, thereby preventing the phase difference between the phase shift unit rows 50H having a parallel relationship and improving the scanning effect of the antenna.

Optionally, referring to FIGS. 19-21, all phase shift units 50 in the scanning antenna 000 may also be a series-parallel hybrid structure for feeding the microwave signals. That is, the scanning antenna 000 may include the plurality of phase shift unit rows 50H; the plurality of first conductive portions 101 in each phase shift unit row 50H may be arranged sequentially along the first direction X and connected with each other to form one phase shift unit row 50H; and the plurality of phase shift unit rows 50H may be sequentially arranged along the second direction Y. Finally, when one end of each phase shift unit row 50H is connected to the feed signal access terminal 40 on the left in FIGS. 19-21, the other end of each phase shift unit row 50H may be connected to the load 70. The load 70 may be used as a wave-absorbing device structure. In each phase shift unit row 50H, matching the load 70 with the output terminals of the plurality of phase shift units 50 which are connected with each other may completely absorb the microwaves reaching the tail-ends of the phase shift units 50 (microstrip line structures), without being reflected back to previous phase shift units 50 (microstrip line structures). The load 70 may be a matched wave absorbing material or a matched circuit structure, which may not be limited in one embodiment.

Figure 22:
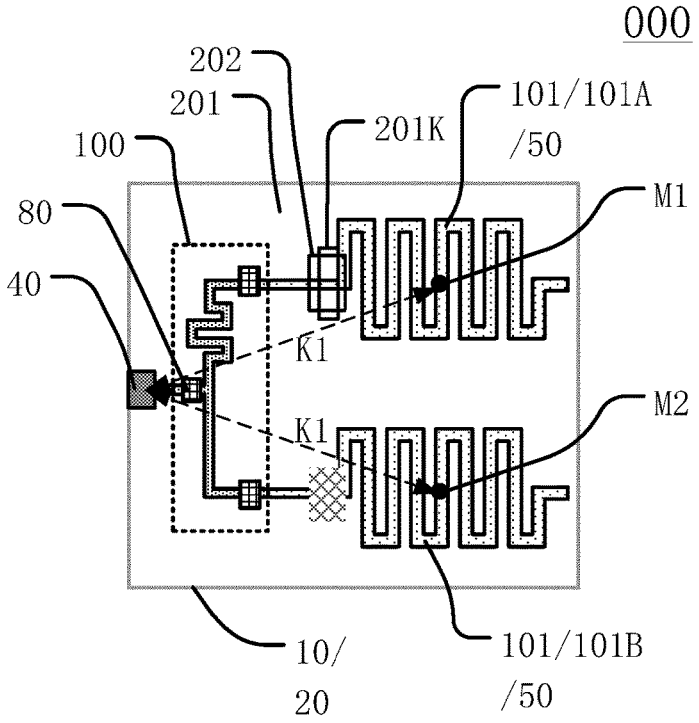
FIG. 22 illustrates another planar structural schematic of an exemplary scanning antenna according to various embodiments of the present disclosure.
Figure 23:
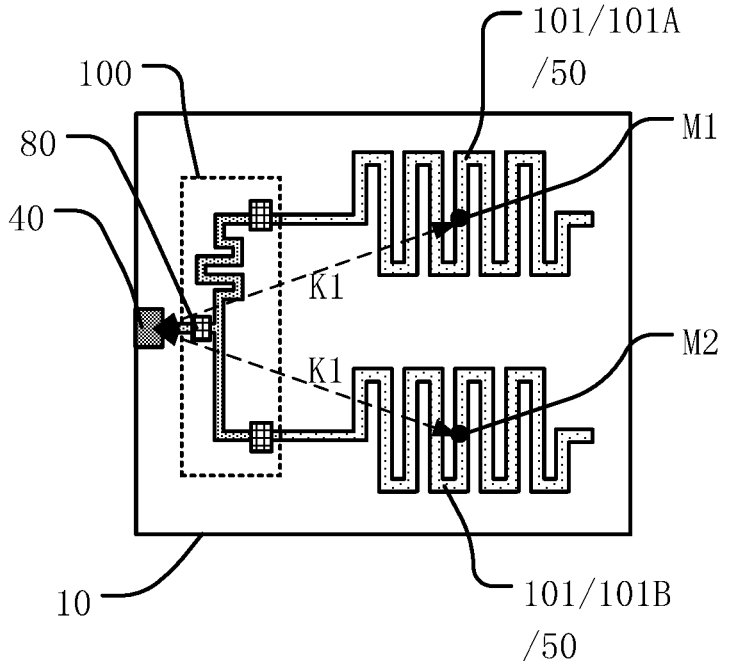
FIG. 23 illustrates a structural schematic of a surface of the first substrate facing the second substrate in FIG. 22.

In some optional embodiments, referring to FIGS. 22-23, FIG. 22 illustrates another planar structural schematic of an exemplary scanning antenna according to various embodiments of the present disclosure (it should be understood that, in order to clearly illustrate the structure of one embodiment, transparency filling may be performed in FIG. 22); and FIG. 23 illustrates a structural schematic of a surface of the first substrate facing the second substrate in FIG. 22. In one embodiment, the scanning antenna 000 may include at least two first conductive portions 101, and the linear distances between the positions of two first conductive portions 101 and the feed signal access terminal 40 may be equal to each other.

The electrical lengths between two first conductive portions 101 and the feed signal access terminal 40 may be different.

In one embodiment, it describes that, in the layout space, the physical distances from different phase shift units 50 in the scanning antenna 000 to the feed signal access terminal 40 can be configured to be equal or nearly equal to each other. That is, the scanning antenna 000 may include at least two first conductive portions 101; and two first conductive portions 101 may be respectively connected to the feed signal access terminal 40. The linear distances between the positions (which can be understood as the points M1 and M2 in FIG. 22 and FIG. 23, the point M1 is the theoretical geometric center point of the position where the first conductive portion 101A is located, and the point M2 is the theoretical geometric center point of the position where the first conductive portion 101B is located) of two first conductive portions 101 (the first conductive portions 101A and 101B in FIGS. 22-23) and the feed signal access terminal 40 may be equal to each other, and both linear distances are K1. The electrical lengths between two first conductive portions 101 and the feed signal access terminal 40 may be configured to be different. For example, the length of the electrical connection line may be increased between one of the two first conductive portions 101 and the feed signal access terminal 40, which may satisfy that the electrical lengths between two adjacent first conductive portions 101 and the feed signal access terminal 40 are different. In one embodiment, at least two first conductive portions 101 may be understood as a parallel structure. Taking two first conductive portions 101 as an example, one terminal of each of two first conductive portions 101 may be connected to the feed signal access terminal 40. Optionally, one terminal of each of two first conductive portions 101 may be connected to the feed signal access terminal 40 through the power divider 100 (to realize one-to-multiple signal transmission function). During an implementation, their own electrical lengths of two adjacent first conductive portions 101 may be same; and the electrical connection line branch of one first conductive portion 101A in the power divider 100 may be partially bent (as shown in FIG. 23). That is, it can realize that the electrical lengths between two adjacent first conductive portions 101 and the feed signal access terminal 40 are different. Furthermore, it can realize that a certain phase difference may be between two adjacent phase shift units 50 (that is, the first conductive portion 101A and the first conductive portion 101B). Then, the overall liquid crystal dielectric constant may be changed by the bias voltage supplied by a bias voltage line connected to both two phase shift units 50, such that the phase difference may be adjusted, and the wave beam scanning may be realized finally.

Optionally, the electrical lengths between two first conductive portions 101 and the feed signal access terminal 40 in one embodiment are different, which may be embodied as that the transmission path lengths from two adjacent first conductive portions 101 to the feed signal access terminal 40 shown in FIGS. 22 and 23 may be different. Therefore, their own electrical lengths of two adjacent first conductive portions 101 (first conductive portions 101A and 101B) may be configured to be same serpentine bending shapes with a same electrical length; and only the lengths of the electrical connection lines between two adjacent first conductive portions 101 and the feed signal access terminal 40 may be different, which may satisfy that the transmission paths from two first conductive portions 101 to the feed signal access terminal 40 are different, thereby realizing the phase difference between two adjacent phase shift units 50.

It can be understood that the shape of the first conductive portion 101 may be exemplarily illustrated in FIGS. 22-23. In an implementation, the shapes of the first conductive portions 101 may include, but may not be limited to, the above-mentioned shapes; and the structures of the phase shift units 50 may be other shapes.

Figure 24:
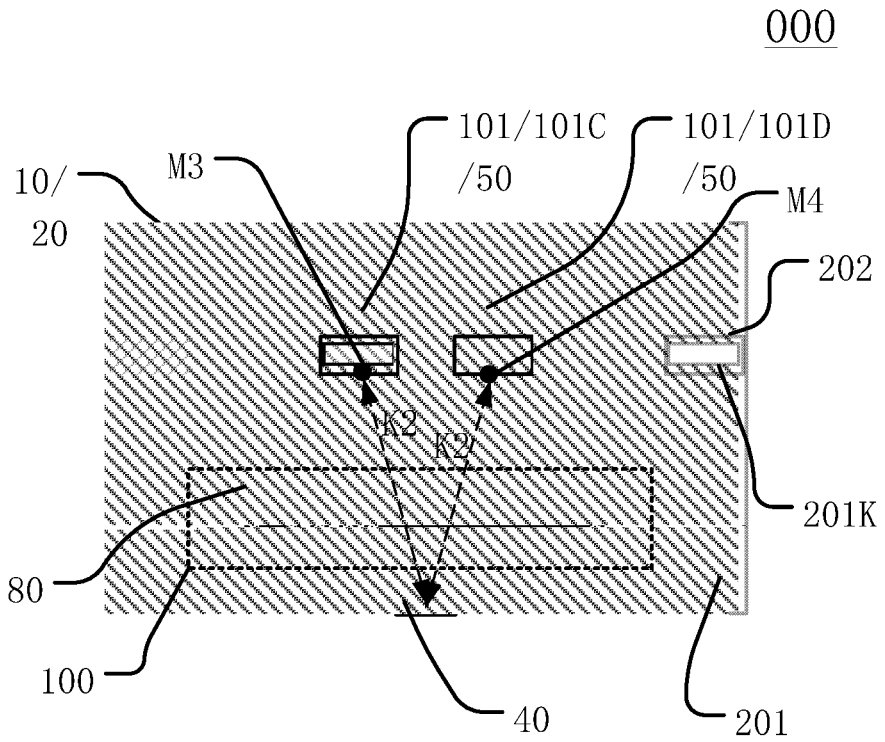
FIG. 24 illustrates another planar structural schematic of an exemplary scanning antenna according to various embodiments of the present disclosure.
Figure 25:
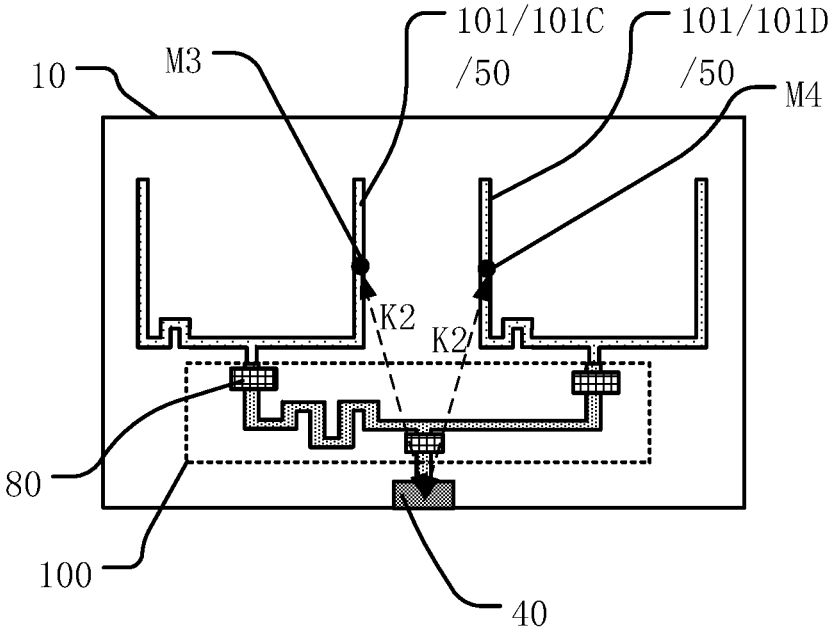
FIG. 25 illustrates a structural schematic of a surface of the first substrate facing the second substrate in FIG. 24.
Figure 26:
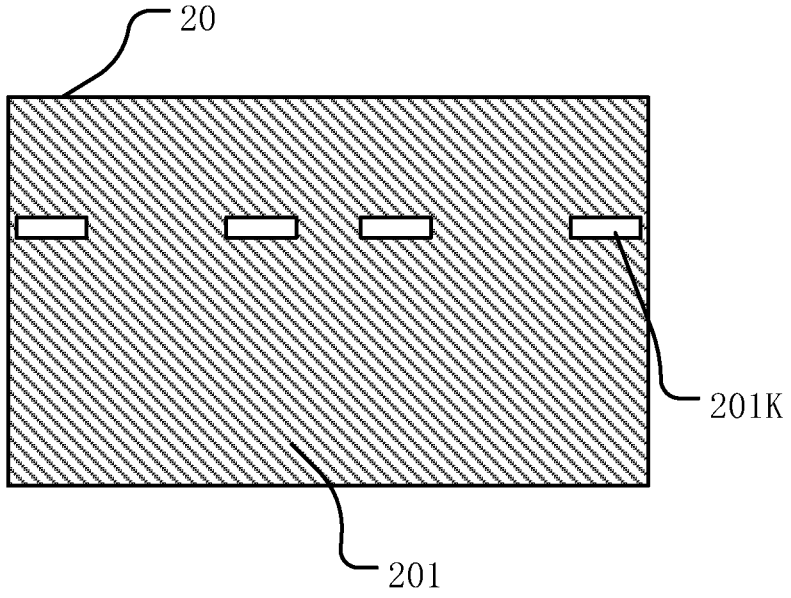
FIG. 26 illustrates a structural schematic of a surface of the second substrate facing the first substrate in FIG. 24.
Figure 27:
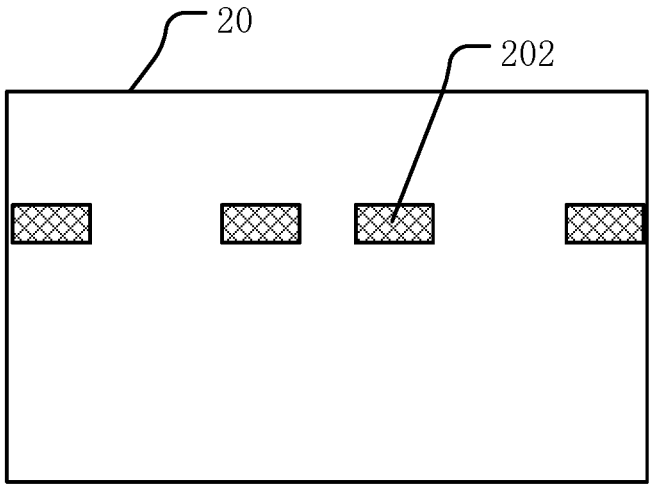
FIG. 27 illustrates a structural schematic of a surface of the second substrate away from the first substrate in FIG. 24.

In some optional embodiments, referring to FIGS. 24-27, FIG. 24 illustrates another planar structural schematic of an exemplary scanning antenna according to various embodiments of the present disclosure (it should be understood that, in order to clearly illustrate the structure of one embodiment, transparency filling may be performed in FIG. 24); FIG. 25 illustrates a structural schematic of a surface of the first substrate facing the second substrate in FIG. 24; FIG. 26 illustrates a structural schematic of a surface of the second substrate facing the first substrate in FIG. 24; and FIG. 27 illustrates a structural schematic of a surface of the second substrate away from the first substrate in FIG. 24. In one embodiment, it describes that, in the layout space, the physical distances from different phase shift units 50 in the scanning antenna 000 to the feed signal access terminal 40 may be configured to be equal or nearly equal with each other. That is, the scanning antenna 000 may include at least two first conductive portions 101. As shown in FIG. 24, four first conductive portions 101 are taken as an example for illustration, and four first conductive portions 101 may be respectively connected to the feed signal access terminal 40. The linear distances between the positions where at least two adjacent first conductive portions 101 (the first conductive portions 101C and 101D in FIGS. 24-27) are located (which can be understood as the points M3 and M4 in FIG. 24 and FIG. 25, the point M3 is the theoretical geometric center point of the position of the first conductive portion 101C, and the point M4 is the theoretical geometric center point of the position of the first conductive portion 101D) to the feed signal access terminal 40 may be same, and both linear distances are K2. The electrical lengths from two adjacent first conductive portions 101 to the feed signal access terminal 40 may be configured to be different. For example, the length of the electrical connection line may be increased in one of the two first conductive portions 101 and the feed signal access terminal 40, which may satisfy that the electrical lengths from two adjacent first conductive portions 101 to the feed signal access terminal 40 are different. In one embodiment, the parallel connection of four first conductive portions 101 may be taken as an example, and one terminal of each of four first conductive portions 101 may be connected to the feed signal access terminal 40. Optionally, one terminal of each of four first conductive portions 101 may be connected to the feed signal access terminal 40 through the power divider 100 (to realize one-to-multiple signal transmission function). In an implementation, their own electrical lengths of two adjacent first conductive portions 101 may be different. As shown in FIG. 25, any two adjacent first conductive portions 101 may have different shapes, and their own electrical lengths may also be different. The electrical length itself of the first conductive portion 101C may be less than the electrical length itself of the first conductive portion 101D, and the electrical connection line branch of the first conductive portion 101 in the power divider 100 may be partially bent (as shown in FIG. 24), which may realize that the electrical lengths between two adjacent first conductive portions 101 and the feed signal access terminal 40 are different. Furthermore, it may realize that a certain phase difference may be between two adjacent phase shift units 50 (that is, two first conductive portions 101). Then, the overall liquid crystal dielectric constant may be changed by the bias voltage supplied by a bias voltage line connected to all four phase shift units 50, such that the phase difference may be adjusted, and the wave beam scanning may be realized finally.

Optionally, in one embodiment, the electrical lengths from four first conductive portions 101 to the feed signal access terminal 40 are different, which may be embodied as that the transmission path lengths from two adjacent first conductive portions 101 to the feed signal access terminal 40 shown in FIGS. 24 and 25 are different. Therefore, their own electrical lengths of two adjacent first conductive portions 101 (the first conductive portions 101C and 101D) may be configured to be different, and the lengths of the electrical connection lines between two adjacent first conductive portions 101 and the feed signal access terminal 40 may be configured to be different, which may satisfy that the transmission paths from two first conductive portions 101 to the feed signal access terminal 40 may be different, and the phase difference between two adjacent phase shift units 50 may be realized.

It should be understood that the shape of the first conductive portion 101 may be exemplarily illustrated in one embodiment in FIGS. 24-25. In an implementation, the shapes of the first conductive portions 101 may include, but may not be limited to, the above-mentioned shapes, and the structures of the phase shift units 50 may be other shapes.

Figure 28:
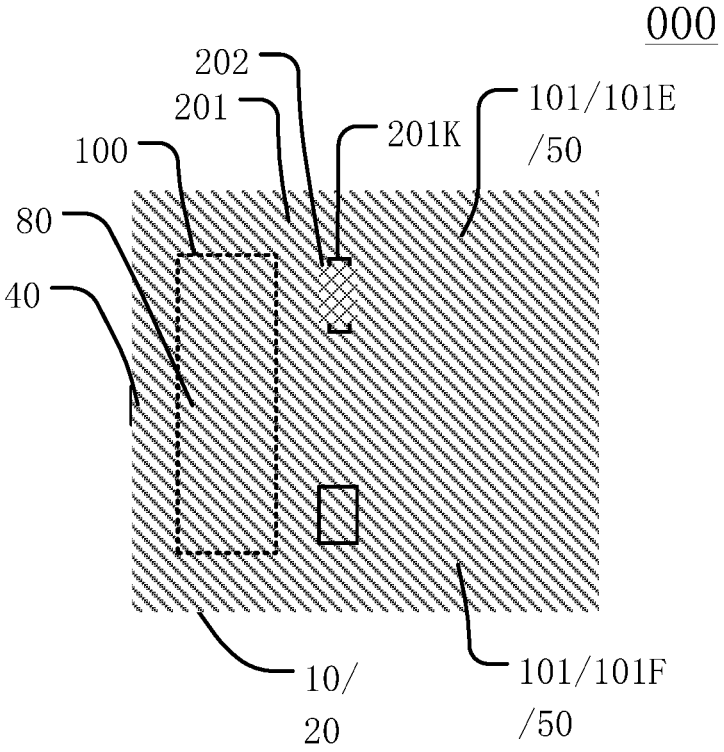
FIG. 28 illustrates another planar structural schematic of an exemplary scanning antenna according to various embodiments of the present disclosure.
Figure 29:
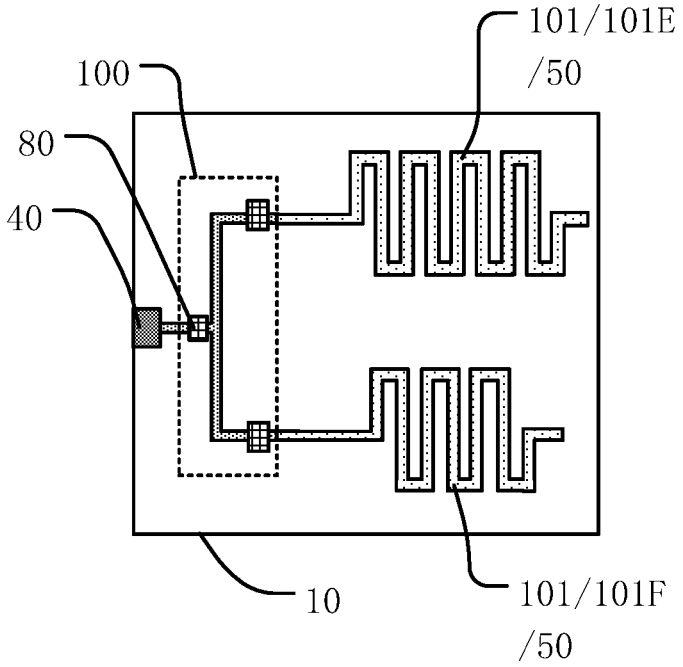
FIG. 29 illustrates a structural schematic of a surface of the first substrate facing the second substrate in FIG. 28.

In some optional embodiments, referring to FIGS. 28-29, FIG. 28 illustrates another planar structural schematic of an exemplary scanning antenna according to various embodiments of the present disclosure (it should be understood that, in order to clearly illustrate the structure of one embodiment, transparency filling may be performed in FIG. 28); and FIG. 29 illustrates a structural schematic of a surface of the first substrate facing the second substrate in FIG. 28. In one embodiment, the electrical lengths from two first conductive portions 101 to the feed signal access terminal 40 are different, which may be embodied as that the transmission path lengths from two first conductive portions 101 to the feed signal access terminal 40 shown in FIGS. 28 and 29 are same, but the shapes of the orthographic projections of two first conductive portions 101 (the first conductive portions 101E and 101F in FIG. 28 and FIG. 29) on the first substrate 10 are different. Therefore, their own electrical lengths of two adjacent first conductive portions 101 may be configured to be different, and the lengths of the electrical connection lines between two adjacent first conductive portions 101 and the feed signal access terminal 40 may be same, which may also satisfy that the transmission path lengths from two first conductive portions 101 to the feed signal access terminal 40 may be same, thereby realizing the phase difference between two adjacent phase shift units 50.

It should be noted that, in FIG. 28 and FIG. 29 of one embodiment, the shapes of the orthographic projections of two first conductive portions 101 onto the first substrate 10 may only be exemplary, which may include, but may not be limited to, such shape. In an implementation, the shapes of the orthographic projections of two first conductive portions 101 on the first substrate 10 may also be two other different shapes. For example, the shape of the microstrip line of one first conductive portion 101 may be a serpentine bending shape, and the shape of the microstrip line of another first conductive portion 101 may be a defective shape (not shown in FIGS. 28-29), which may not be limited in one embodiment and may be configured according to actual requirements during an implementation.

Figure 30:
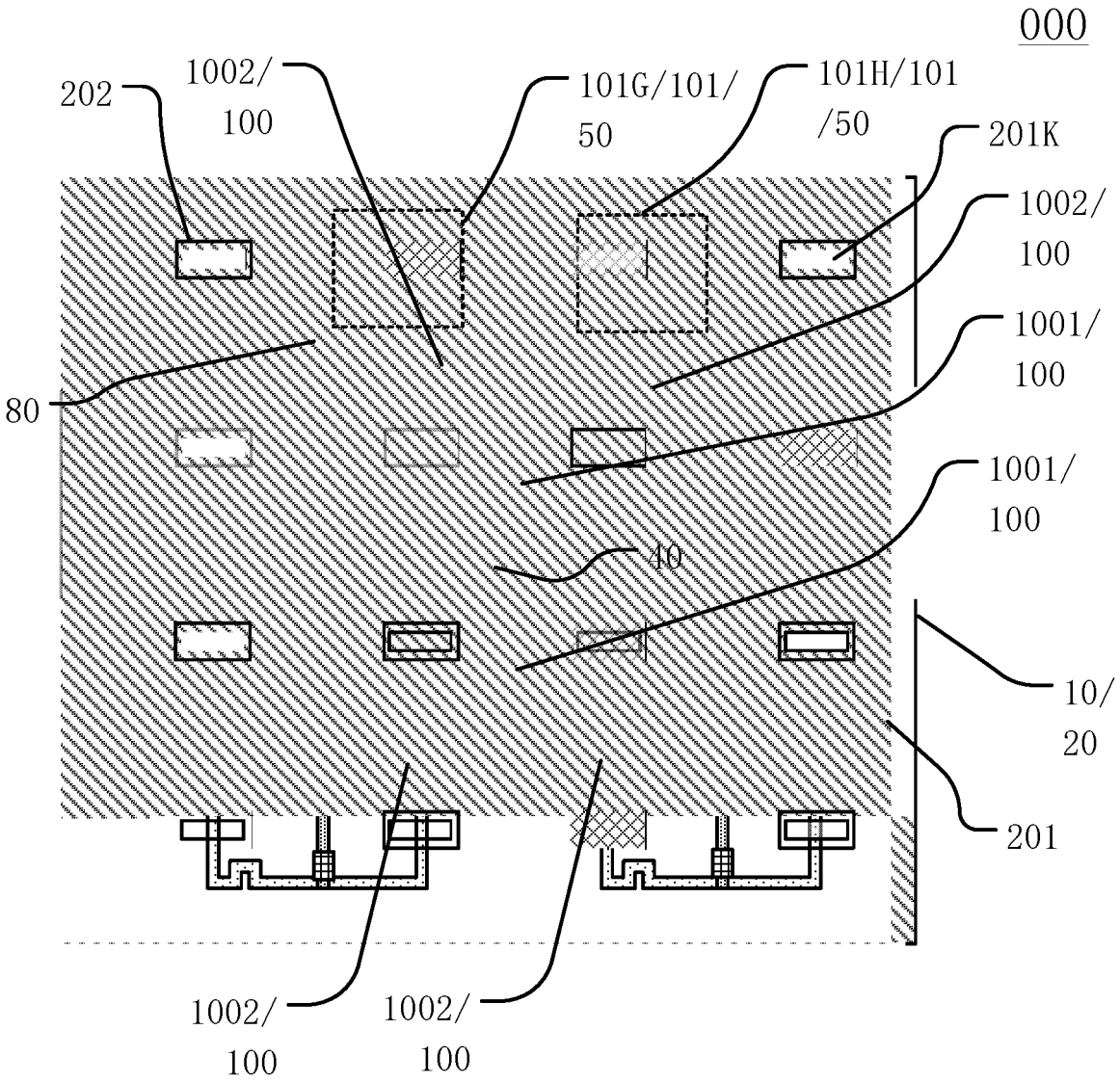
FIG. 30 illustrates another planar structural schematic of an exemplary scanning antenna according to various embodiments of the present disclosure.
Figure 31:
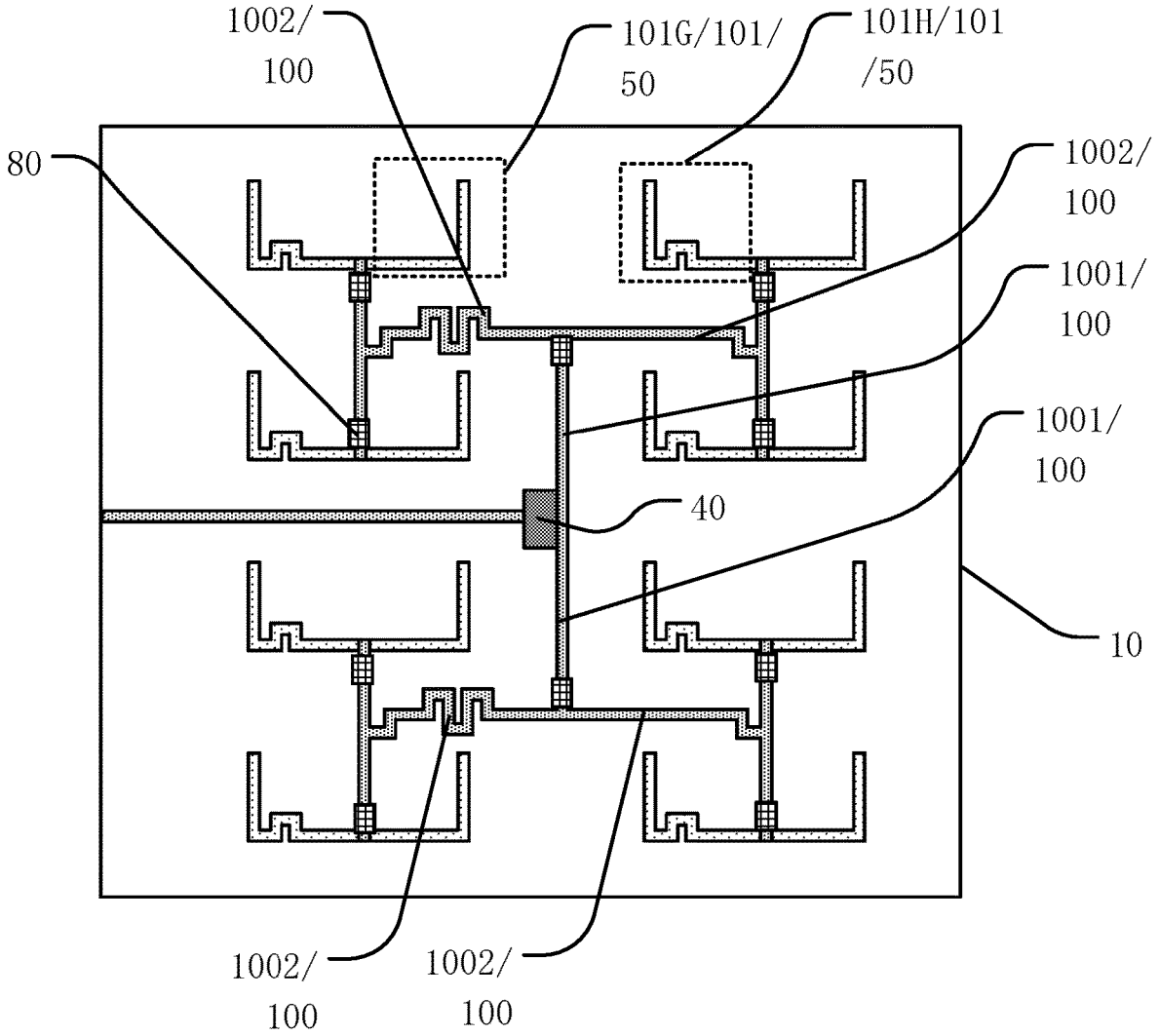
FIG. 31 illustrates a structural schematic of a surface of the first substrate facing the second substrate in FIG. 30.
Figure 32:
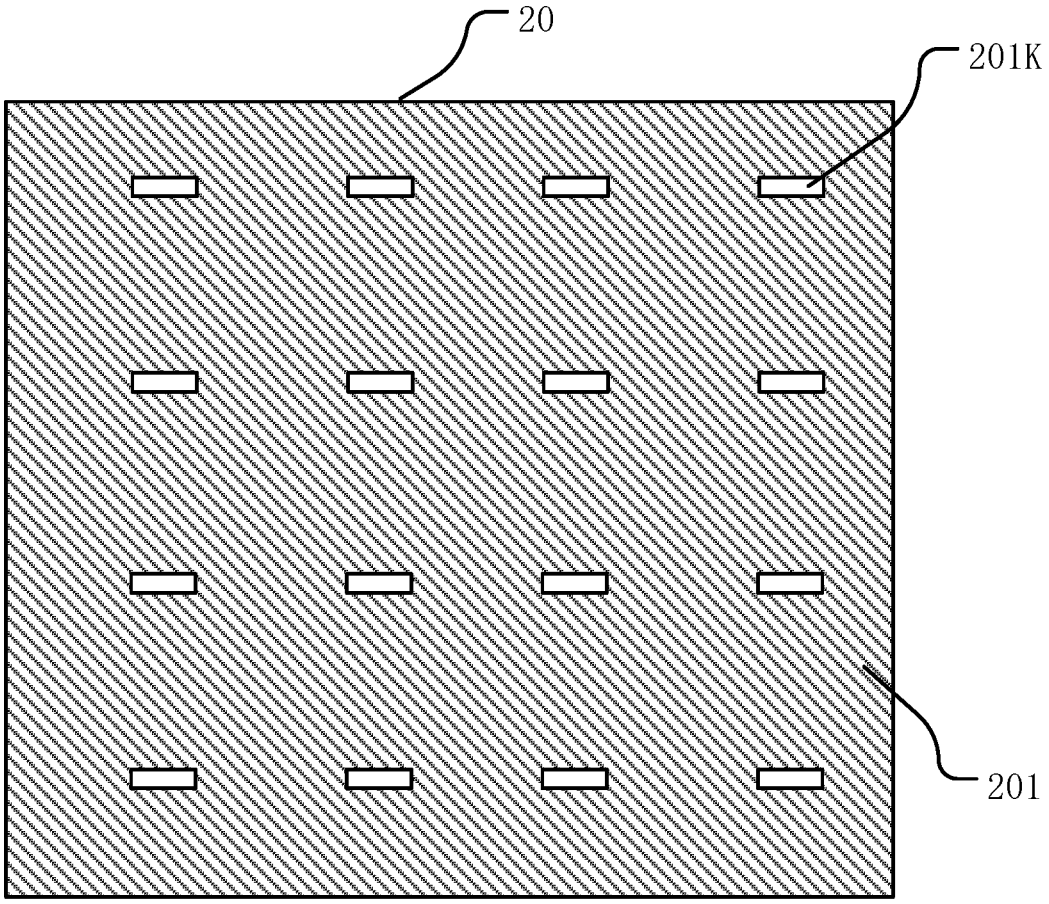
FIG. 32 illustrates a structural schematic of a surface of the second substrate facing the first substrate in FIG. 30.
Figure 33:
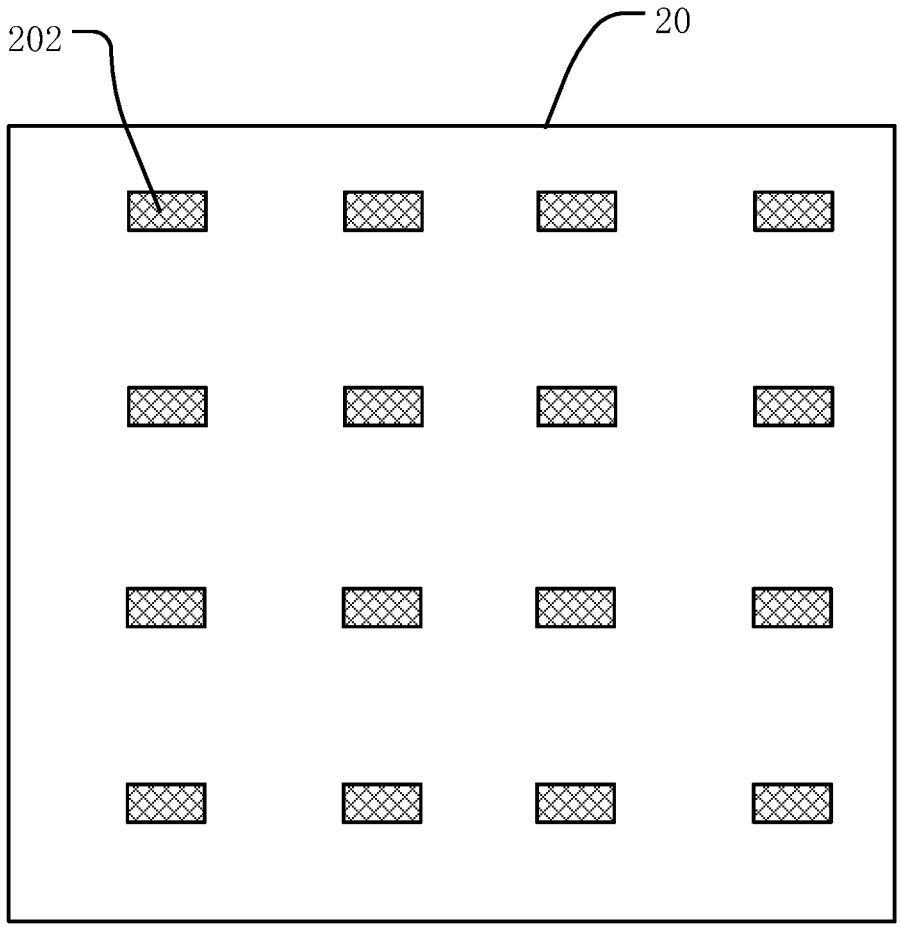
FIG. 33 illustrates a structural schematic of a surface of the second substrate away from the first substrate in FIG. 30.

In some optional embodiments, referring to FIGS. 30-33, FIG. 30 illustrates another planar structural schematic of an exemplary scanning antenna according to various embodiments of the present disclosure (it should be understood that, in order to clearly illustrate the structure of one embodiment, transparency filling may be performed in FIG. 30); FIG. 31 illustrates a structural schematic of a surface of the first substrate facing the second substrate in FIG. 30; FIG. 32 illustrates a structural schematic of a surface of the second substrate facing the first substrate in FIG. 30; and FIG. 33 illustrates a structural schematic of a surface of the second substrate away from the first substrate in FIG. 30. In one embodiment, at least two first branch structures 1001 may be connected to the feed signal access terminal 40; at least two second branch structures 1002 may be connected to each first branch structure 1001; and at least two first conductive portions 101 may be connected to each second branch structure 1002. Optionally, in FIGS. 30 and 31, each second branch structure 1002 may be connected with four first conductive portions 101 as an example for illustration.

The plurality of first conductive portions 101 may be arranged in an array. Optionally, the linear distances between the positions of two adjacent first conductive portions 101 and the feed signal access terminal 40 may be equal to each other.

The electrical lengths between at least two first conductive portions 101 and the feed signal access terminal 40 may be different.

In one embodiment, it describes that when the feed signal access terminal 40 is connected in parallel with the plurality of first conductive portions 101, the power divider 100 (to realize one-to-multiple signal transmission function) arranged between the feed signal access terminal 40 and the plurality of first conductive portions 101 may be a T-shaped power divider structure. That is, the feed signal access terminal 40 may be connected with at least two first branch structures 1001 (which can be understood as the first-level branch of the power divider 100), and each first branch structure 1001 may be connected with at least two second branch structures 1002 (which can be understood as the secondary branch of the power divider 100, where in FIGS. 30 and 31, each second branch structure 1002 may be connected with four first conductive portions 101 as an example for illustration; and when there are more than four first conductive portions 101, the third-level branch, the fourth-level branch and the like may also be continuously disposed, which may not be limited in one embodiment). In one embodiment, four first conductive portions 101 may be connected to each second branch structure 1002 as an example for illustration. In one embodiment, the power divider 100 with multi-level branches may be disposed, and the plurality of first conductive portions 101 may be arranged in an array-arrangement structure. Optionally, in one embodiment, the feed signal access terminal 40 may be arranged at a position close to the geometric center of the first substrate 10 (as shown in FIG. 31). Therefore, the linear distances between the positions of two adjacent first conductive portions 101 (the first conductive portions 101G and 101H in FIG. 31) and the feed signal access terminal 40 may be equal to each other; that is, the physical distances from the positions of all first conductive portions 101 to the feed signal access terminal 40 in the layout space may be equal to each other. However, in the plurality of first conductive portions 101, the electrical lengths between two adjacent first conductive portions 101 and the feed signal access terminal 40 may be different. Optionally, one terminal of each first conductive portion 101 may be connected to the first branch structure 1001 of the power divider 100 through the second branch structure 1002 of the power divider 100 and may realize the respective connection with the feed signal access terminal 40 through the first branch structure 1001. In an implementation, their own electrical lengths of two adjacent first conductive portions 101 in the plurality of first conductive portions 101 may be same or different (in FIGS. 30-31, their own electrical lengths of two adjacent first conductive portions 101 are different as an example for illustration), and then the second branch structure 1002 of the electrical connection line of the first conductive portion 101 in the power divider 100 (as shown in FIG. 30 and FIG. 31) may be partially bent. Therefore, the electrical lengths between two adjacent first conductive portions 101 and the feed signal access terminal 40 may be different. Furthermore, it may realize that there is a certain phase difference between two adjacent phase shift units 50 (that is, two different adjacent first conductive portions 101). Then, the overall liquid crystal dielectric constant may be changed by the bias voltage supplied by a bias voltage line connected to all phase shift units 50, such that the phase difference may be adjusted, and the wave beam scanning may be realized finally. The gain of the scanning antenna 000 is proportional to the overall number of radiating units. In one embodiment, all phase shift units 50 (all first conductive portions 101) in the scanning antenna 000 may be designed as an array-arrangement structure, that is, all phase shift units 50 may be a parallel array-arrangement design. The number of phase shift units 50 arranged in the array may be more than that of the linear array structure, which may have relatively large gain. In one embodiment, in order to increase the antenna gain, the antenna may be designed into an array-arrangement format. The power divider 100 (to realize one-to-multiple signal transmission function) may be used at the feed signal access terminal 40 to distribute the microwave signals to each of the first conductive portions 101 connected in parallel. In such way, while wave beam scanning can be realized, the gain of the entire scanning antenna 000 may also be improved.

Figure 34:
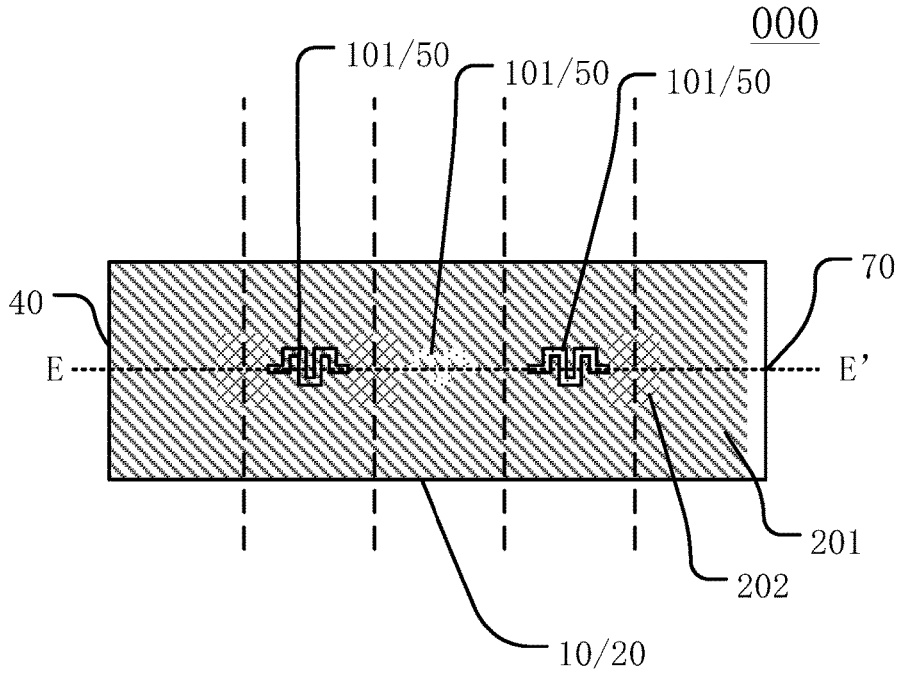
FIG. 34 illustrates another planar structural schematic of an exemplary scanning antenna according to various embodiments of the present disclosure.
Figure 35:
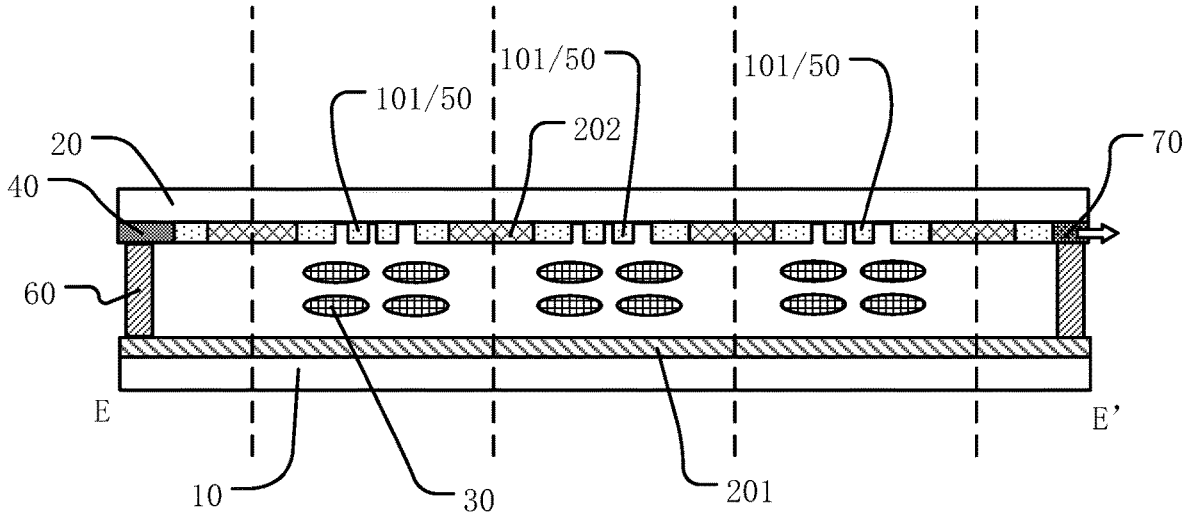
FIG. 35 illustrates a cross-sectional structural schematic along an E-E' direction in FIG. 34.
Figure 36:
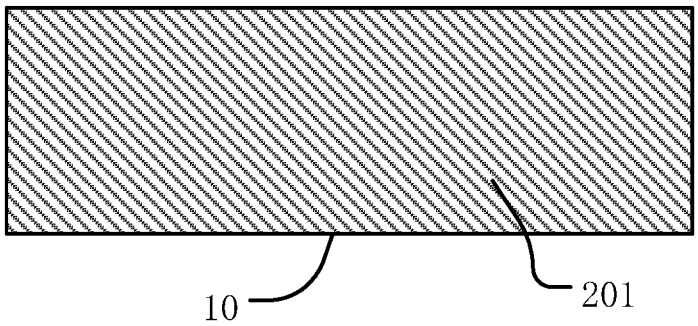
FIG. 36 illustrates a structural schematic of a surface of the first substrate facing the second substrate in FIG. 34.
Figure 37:
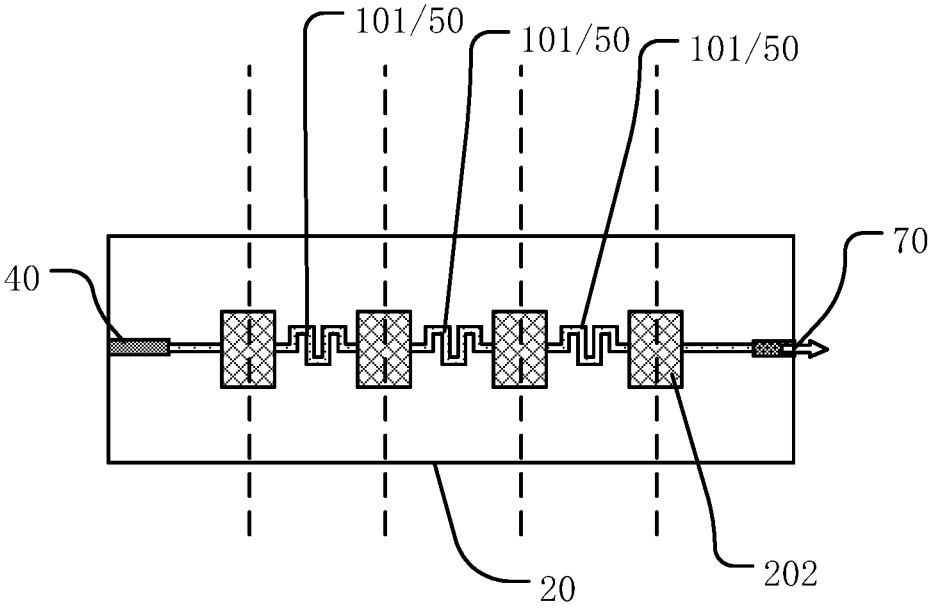
FIG. 37 illustrates a structural schematic of a surface of the second substrate facing the first substrate in FIG. 34.

In some optional embodiments, referring to FIGS. 34-37, FIG. 34 illustrates a structural schematic of a surface of the first substrate facing the second substrate in FIG. 19; FIG. 35 illustrates a cross-sectional structural schematic along an E-E' direction in FIG. 34 (it should be understood that, in order to clearly illustrate the structure of one embodiment, transparency filling may be performed in FIG. 34); FIG. 36 illustrates a structural schematic of a surface of the first substrate facing the second substrate in FIG. 34; and FIG. 37 illustrates a structural schematic of a surface of the second substrate facing the first substrate in FIG. 34. In one embodiment, the phase shift unit 50 of the scanning antenna 000 may include the first conductive portion 101, the first conductive portion 101 may be a microstrip line structure for wave transmission function; and the first conductive portion 101 may be disposed on the side of the second substrate 20 facing the first substrate 10. Optionally, the shape of the first conductive portion 101 in one embodiment may be a serpentine bending shape as an example. The shape of the first conductive portion 101 may include, but may not be limited to, the serpentine bending shape, which may refer to illustration of the above-mentioned embodiments and may not be described in detail in one embodiment.

The side of the first substrate 10 facing the second substrate 20 may include the second conductive portion 201.

The side of the second substrate 20 facing the first substrate 10 may further include the third conductive portion 202. The third conductive portion 202 may be directly connected to the first conductive portion 101.

The feed signal received by the feed signal access terminal 40 may be transmitted to the first conductive portions 101, and the first conductive portions 101 may directly transmit the signal to the third conductive portions 202 at different positions.

Optionally, the second conductive portion 201 may be an entire surface structure; the second conductive portion 201 may be connected to a ground signal; and the third conductive portion 202 may be a block-shaped structure.

In one embodiment, it describes that the scanning antenna 000 may be a two-layer metal conductive structure arranged on the first substrate 10 and the second substrate 20. The side of the first substrate 10 facing the second substrate 20 may be disposed with the second conductive portion 201 which is an entire surface structure connected to a ground signal (e.g., a metal ground layer). The first conductive portion 101 (phase shift unit 50) of the microstrip line structure used for wave transmission function and the third conductive portion 202 may both be disposed on the side of the second substrate 20 facing the first substrate 10. The third conductive portion 202 may be a block-shaped structure and used as a radiation patch for radiating microwave signals. The third conductive portion 202 may be directly connected to the first conductive portion 101. When the feed signal received by the feed signal access terminal 40 is transmitted to the first conductive portions 101, by the direct connection between the first conductive portions 101 and the third conductive portions 202, the first conductive portions 101 may directly transmit the signal to the third conductive portions 202 in different positions, thereby realizing the radiation of microwave signal energy. The scanning antenna 000 configured in one embodiment may also only need one bias voltage line to apply a bias voltage between the first conductive portion 101 of the microstrip line structure and the second conductive portion 201 of the metal ground layer; and complicated bias circuits may not be needed, which may not only realize one-dimensional beam scanning, but also be beneficial for reducing production costs and reducing wiring difficulty. In addition, the first conductive portion 101 of the microstrip line structure and the third conductive portion 202 of the radiation patch may be directly connected, which can avoid the coupling loss when the radiation patch and the microstrip line are disposed at different metal conductive layers. Moreover, the metal conductive layer may only be disposed on one side of the first substrate 10 and the second substrate 20, such that the manufacturing process may be simpler with low cost.

Optionally, the scanning antenna 000 may also include the load 70. One end of the first conductive portion 101 of the microstrip line structure and the third conductive portion 202 of the radiation patch which are directly connected with each other may be connected to the feed signal access terminal 40. Another end of the first conductive portion 101 of the microstrip line structure and the third conductive portion 202 of the radiation patch which are directly connected with each other may be connected to the load 70. The load 70 can be a wave-absorbing device structure, which allows the microwaves reaching the tail-ends of the phase shift units 50 (microstrip line structures) to be completely consumed, without being reflected back to the previous phase shift units 50 (microstrip line structures). The load 70 may be a matched wave absorbing material or a matched circuit structure, which may not be limited in one embodiment.

Figure 38:
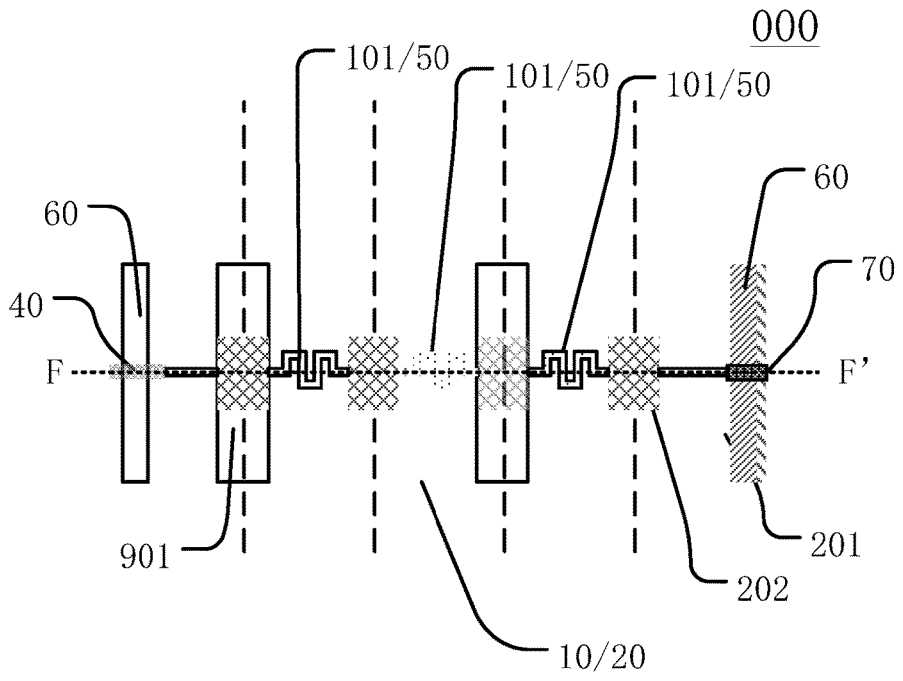
FIG. 38 illustrates another planar structural schematic of an exemplary scanning antenna according to various embodiments of the present disclosure.
Figure 39:
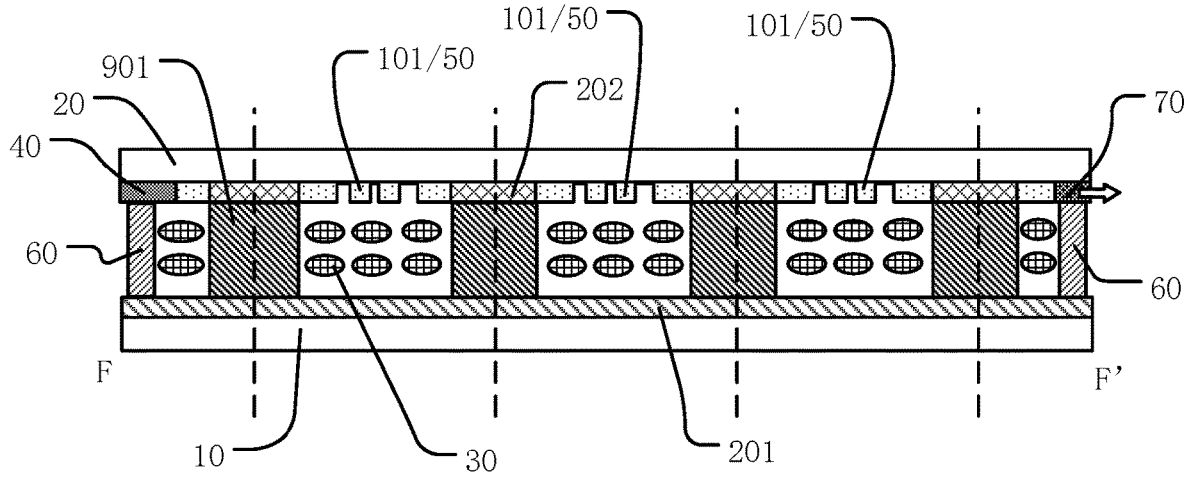
FIG. 39 illustrates a cross-sectional structural schematic along an F-F' direction in FIG. 38.

In some optional embodiments, referring to FIGS. 38-39, FIG. 38 illustrates another planar structural schematic of an exemplary scanning antenna according to various embodiments of the present disclosure; and FIG. 39 illustrates a cross-sectional structural schematic along an F-F' direction in FIG. 38 (it should be understood that, in order to clearly illustrate the structure of one embodiment, transparency filling may be performed in FIG. 38). In one embodiment, the first dielectric layer 901 may be further included between the first substrate 10 and the second substrate 20. The orthographic projection of the first dielectric layer 901 on the first substrate 10 may overlap the orthographic projection of the third conductive portion 202 on the first substrate 10. The orthographic projection of the first dielectric layer 901 on the first substrate 10 may not overlap the orthographic projection of the liquid crystal layer 30 on the first substrate 10.

The first dielectric layer 901 may include air and/or a solid dielectric.

In the scanning antenna 000 provided in one embodiment, since the plurality of phase shift units 50 are connected with each other, only one bias voltage line may be needed to apply a bias voltage between the phase shift units 50 of the microstrip line structures and the metal ground layer 02, and complicated bias circuits may not be needed. In addition, since each phase shift unit 50 is connected to the feed signal access terminal 40, no coupling loss may be between the feed power division network and the phase shift unit, which may not only realize one-dimensional wave beam scanning, but also have desirable scanning effect. It is beneficial for reducing production costs and wiring difficulty and can be applied to scenes such as high-speed trains, subway lines, and the like.

Since the third conductive portion 202 of the radiation patch is directly connected to the first conductive portion 101 of the microstrip line, the liquid crystal dielectric change of the liquid crystal layer 30 under the third conductive portion 202 may affect the resonant frequency of the radiation patch. Therefore, in one embodiment, the first dielectric layer 901 may be disposed between the first substrate 10 and the second substrate 20, such that the orthographic projection of the first dielectric layer 901 on the first substrate 10 may overlap the orthographic projection of the third conductive portion 202 on the first substrate 10. That is, the orthographic projection of the first dielectric layer 901 on the first substrate 10 may not overlap the orthographic projection of the liquid crystal layer 30 on the first substrate 10. The material of the first dielectric layer 901 may be a low-loss material, such as air, or a solid dielectric, or may also be a mixed material of air and a solid dielectric, which may not be limited in one embodiment, as long as the first dielectric layer 901 is a low-loss material. In one embodiment, the first dielectric layer 901 may be disposed in the region corresponding to the third conductive portion 202 of the radiation patch, such that the liquid crystal molecules of the liquid crystal layer 30 may avoid appearing in the region where the radiation patch is located, which may prevent the dielectric change of the liquid crystal from affecting the resonant frequency of the radiation patch. In addition, the influence on the radiation wave beam of the radiation patch may be avoided when the first conductive portion 101 of the microstrip line structure itself has a certain degree of radiation leakage, thereby further being beneficial for improving the antenna effect.

In some optional embodiments, referring to FIGS. 10, 13, and 34-39, the first conductive portion 101 may include one of a linear line shape, a curved line shape, a zigzag line shape, and/or any other suitable shapes.

In one embodiment, it further describes that the shape of each first conductive portion 101 used as the microstrip line may be a linear line shape, a curved line shape (refer to embodiments corresponding to FIG. 10 and FIG. 13 for details), or a zigzag line shape as shown in FIGS. 34-39, which may not be limited according to various embodiments of the present disclosure. It may only need to satisfy that the electrical lengths of the first conductive portions 101 fed from the feed signal access terminal 40 to the phase shift unit 50 are different. Therefore, the physical path lengths of the microwave signals that reach the third conductive portions 202 of the radiation patches may be inconsistent, showing an arithmetic relationship. That is, an initial phase difference may be provided to each microwave signal. Then, only the bias voltage supplied by a bias voltage line may change the overall liquid crystal dielectric constant, such that the phase difference may be adjusted, and the wave beam scanning of the scanning antenna 000 in one embodiment may be finally realized. It can be understood that included shapes of the first conductive portions 101 may only be shown in one embodiment, which may not be limited according to various embodiments of the present disclosure. In an implementation, the shapes of the first conductive portions 101 used as the microstrip lines may also include slow-wave-like structures such as defective ground structures, composite left-right-handed structures and the like, and include other shapes, which may not be described in detail in one embodiment.

Optionally, referring to FIGS. 34, 37, and 38, the first conductive portion 101 may be a serpentine bending shape. In one embodiment, the first conductive portion 101 of a zigzag line shape, a curved line shape, or a serpentine bending shape may be configured, such that it realizes that the part of the first conductive portion 101 used as the microstrip line may be increased. A relatively large phase shift magnitude may be achieved by further increasing the length of the microstrip line between adjacent phase shift units 50, which may be beneficial for improving the scanning effect of the scanning antenna 000.

Furthermore, optionally, referring to FIGS. 34-39, the structure of the direct connection between the first conductive portions 101 and the third conductive portions 202 may be that the plurality of first conductive portions 101 and the plurality of third conductive portions 202 may be arranged sequentially along a same direction and connected with each other; one first conductive portion 101 may be between two adjacent third conductive portions 202; one end of the first conductive portion 101 may be connected to one third conductive portion 202; and another end of the first conductive portion 101 may be connected to another third conductive portion 202.

Figure 40:
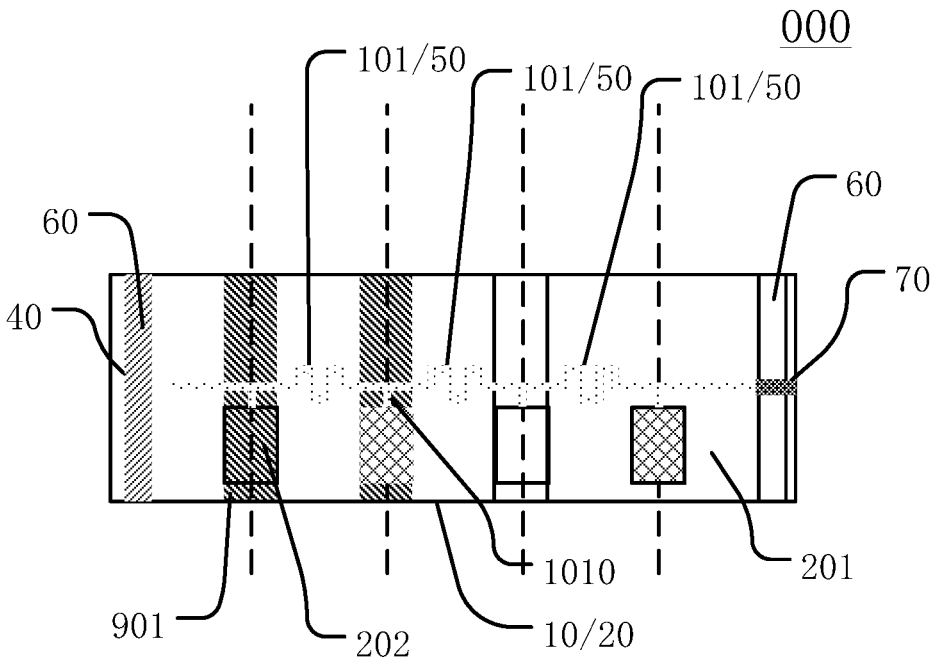
FIG. 40 illustrates another planar structural schematic of an exemplary scanning antenna according to various embodiments of the present disclosure.
Figure 41:
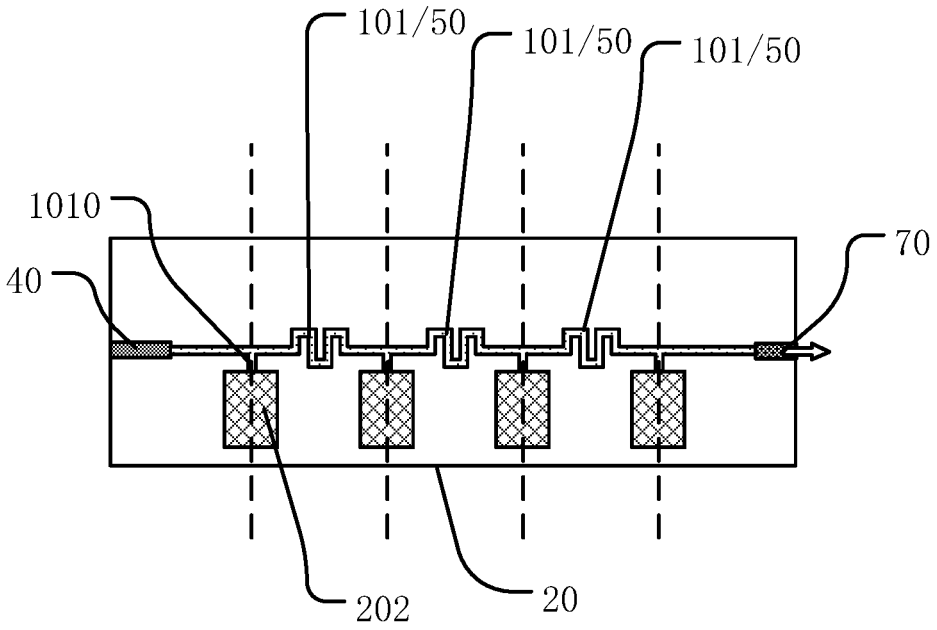
FIG. 41 illustrates a structural schematic of a surface of the second substrate facing the first substrate in FIG. 40.

Furthermore, optionally, referring to FIGS. 40-41, FIG. 40 illustrates another planar structural schematic of an exemplary scanning antenna according to various embodiments of the present disclosure; and FIG. 41 illustrates a structural schematic of a surface of the second substrate facing the first substrate in FIG. 40. In one embodiment, the structure of the direct connection between the first conductive portions 101 and the third conductive portions 202 may also be that the plurality of first conductive portions 101 may be arranged sequentially along a same direction and connected with each other; a branch line 1010 may be included between two adjacent first conductive portions 101; the third conductive portion 202 may be connected to the first conductive portion 101 through the branch line 1010; one end of the branch line 1010 may be connected to the first conductive portion 101 at the position between two adjacent first conductive portions 101; and another end of the branch line 1010 may be connected to the third conductive portion 202.

It can be understood that the structure of the direct connection between the first conductive portions 101 and the third conductive portions 202 on the surface of the second substrate 20 facing the first substrate 10 may not be limited in one embodiment. During an implementation, any connection manner in the above-mentioned embodiments may be used, which may only need to satisfy that the first conductive portions 101 and the third conductive portions 202 are all disposed on the surface of the second substrate 20 facing the first substrate 10, and the first conductive portions 101 and the third conductive portions 202 are directly connected.

Figure 42:
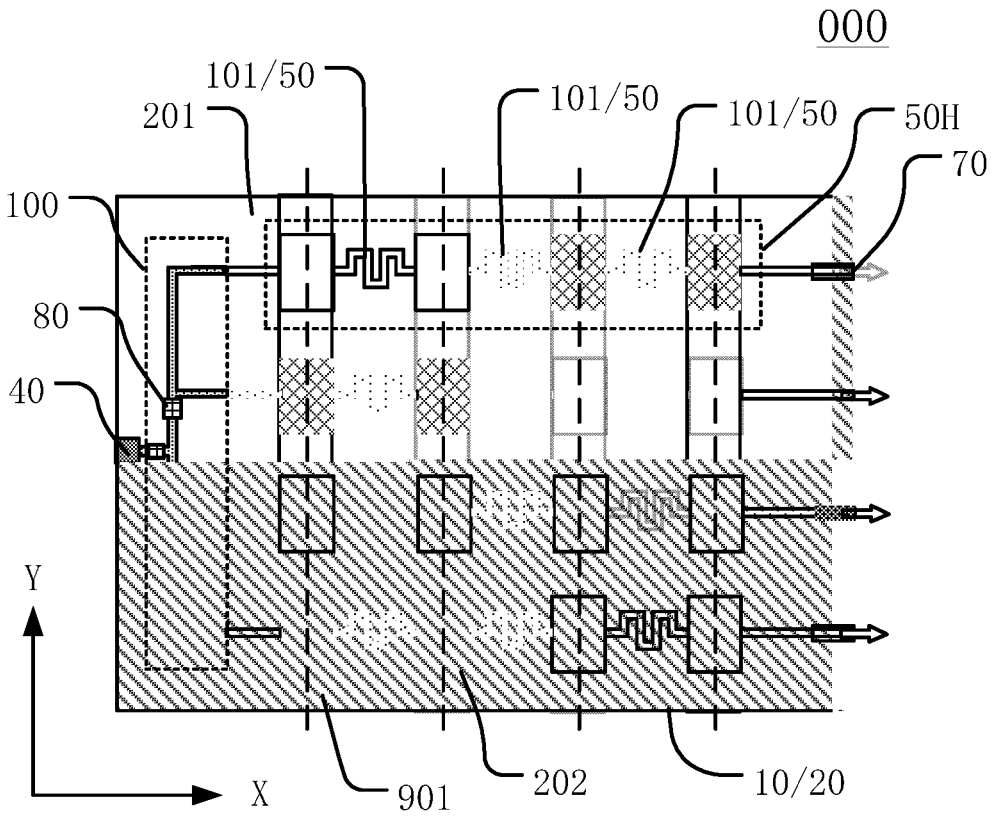
FIG. 42 illustrates another planar structural schematic of an exemplary scanning antenna according to various embodiments of the present disclosure.
Figure 43:
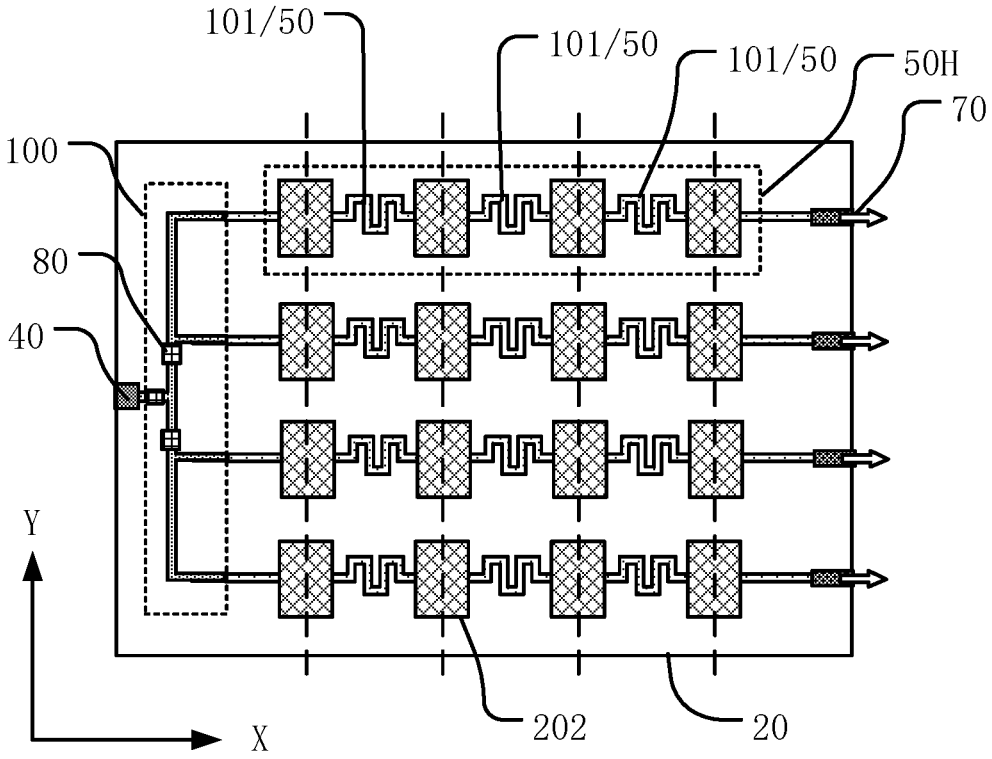
FIG. 43 illustrates a structural schematic of a surface of the second substrate facing the first substrate in FIG. 42.
Figure 44:
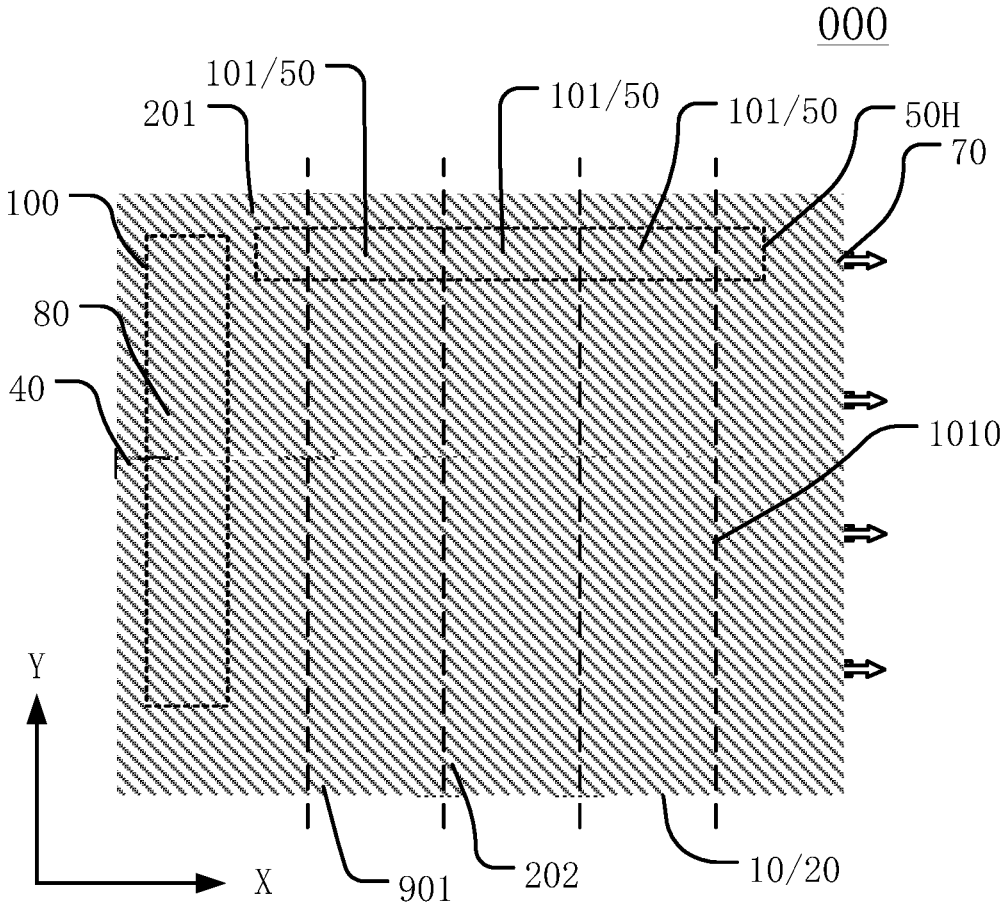
FIG. 44 illustrates another planar structural schematic of an exemplary scanning antenna according to various embodiments of the present disclosure.
Figure 45:
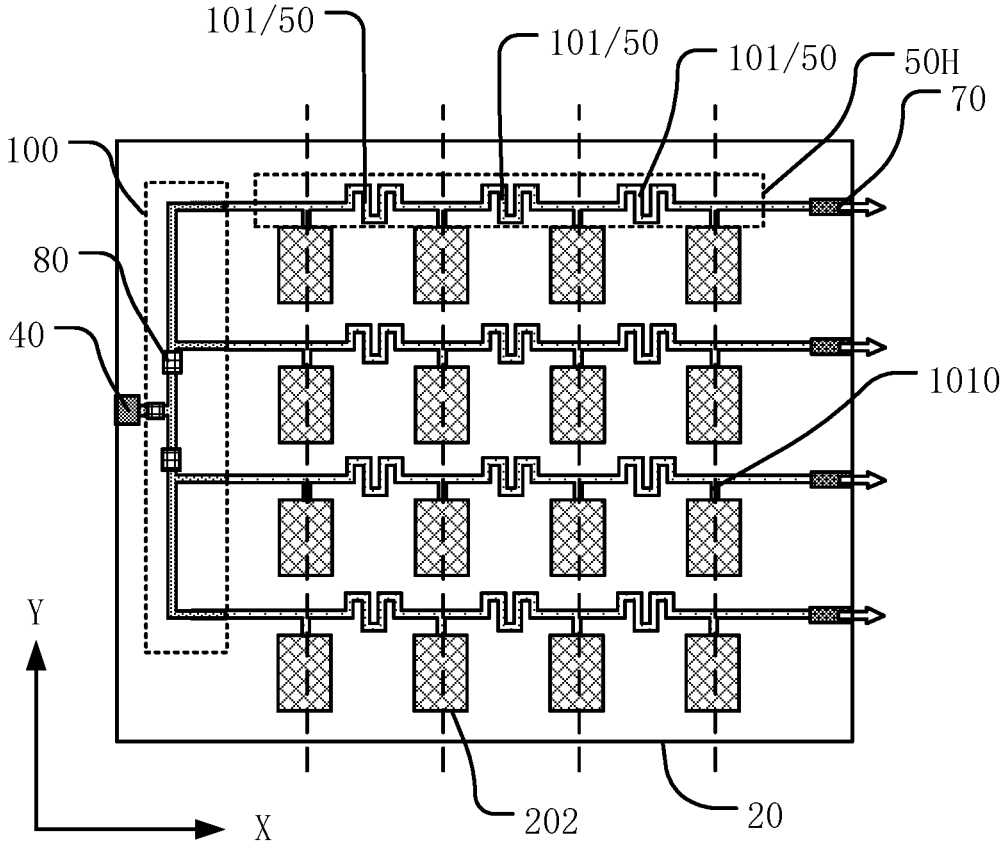
FIG. 45 illustrates a structural schematic of a surface of the second substrate facing the first substrate in FIG. 44.

In some optional embodiments, referring to FIGS. 42-45, FIG. 42 illustrates another planar structural schematic of an exemplary scanning antenna according to various embodiments of the present disclosure (it should be understood that, in order to clearly illustrate the structure of one embodiment, transparency filling may be performed in FIG. 42); FIG. 43 illustrates a structural schematic of a surface of the second substrate facing the first substrate in FIG. 42; FIG. 44 illustrates another planar structural schematic of an exemplary scanning antenna according to various embodiments of the present disclosure (it should be understood that, in order to clearly illustrate the structure of one embodiment, transparency filling may be performed in FIG. 44); and FIG. 45 illustrates a structural schematic of a surface of the second substrate facing the first substrate in FIG. 44. In one embodiment, the scanning antenna 000 may include a plurality of phase shift unit rows 50H; the plurality of first conductive portions 101 may be arranged sequentially along the first direction X and connected with each other to form one phase shift unit row 50H; and the plurality of phase shift unit rows 50H may be sequentially arranged along the second direction Y. Along the direction in parallel with the plane where the first substrate 10 is located, the first direction X may intersect the second direction Y. Optionally, in one embodiment, along the direction in parallel with the plane where the first substrate 10 is located, the first direction X and the second direction Y may be perpendicular to each other as an example for illustration.

One end of each phase shift unit row 50H may be connected to the feed signal access terminal 40.

In one embodiment, it describes that each phase shift unit 50 in the scanning antenna 000 may also be a series-parallel hybrid structure for feeding the microwave signals. That is, the scanning antenna 000 may include the plurality of phase shift unit rows 50H; the plurality of first conductive portions 101 in each phase shift unit row 50H may be arranged sequentially along the first direction X and connected with each other to form one phase shift unit row 50H; the plurality of phase shift unit rows 50H may be sequentially arranged along the second direction Y; and finally, one end of each phase shift unit row 50H may be connected to the feed signal access terminal 40 on the left side in FIGS. 42 and 45. The gain of the scanning antenna 000 is proportional to the overall number of radiating units. In one embodiment, all phase shift units 50 in the scanning antenna 000 may be designed as a surface array structure, that is, all phase shift units 50 may be a series-parallel hybrid design. The number of phase shift units 50 of the surface array structure may be more than that of the linear array structure, such that the surface array structure may have relatively large gain. In one embodiment, in order to increase the antenna gain, the antenna may be designed in the form of a surface array, and a power divider 100 (to realize one-to-multiple signal transmission function) may be used at the feed signal access terminal 40 to distribute the microwave signals to the phase shift units 50 of each phase shift unit row 50H. Therefore, while one-dimensional beam scanning may be realized, the gain of the entire scanning antenna 000 may also be improved.

Optionally, in FIGS. 42-45 of one embodiment, the feed signal access terminal 40 may be only at the middle position of four phase shift unit rows 50H along the second direction Y. That is, four phase shift unit rows 50H may be symmetrical on two sides of the feed signal access terminal 40. Therefore, the phase difference between different phase shift unit rows 50H along the second direction Y may be reduced, and the one-dimensional beam scanning along the first direction X may be better realized.

Furthermore, optionally, as shown in FIGS. 42-45, when the feed signal access terminal 40 of one embodiment is connected to each phase shift unit row 50H, one adjustment load 80 may be added between the feed signal access terminal 40 and a part of the phase shift unit rows 50H to adjust the electrical lengths from the phase shift unit rows 50H to the feed signal access terminal 40. By configuring the magnitude of the adjustment load 80, the phase difference between different phase shift unit rows 50H along the second direction Y may be further reduced, and the effect of scanning the antenna may be increased.

Optionally, another end of each phase shift unit row 50H may be connected to the load 70. The load 70 may be used as a wave-absorbing device structure. In each phase shift unit row 50H, matching the load 70 with the output terminals of the plurality of phase shift units 50 which are connected with each other may completely absorb the microwaves reaching the tail-ends of the phase shift units 50 (microstrip line structures), without being reflected back to previous phase shift units 50 (microstrip line structures). The load 70 may be a matched wave absorbing material or a matched circuit structure, which may not be limited in one embodiment.

It can be understood that, in one embodiment, each phase shift unit row 50H may include three connected first conductive portions 101, one third conductive portion 202 may be connected between every two adjacent first conductive portions 101, and the scanning antenna 000 may include four phase shift unit rows 50H arranged sequentially along the second direction Y, which may be used as an example for schematic illustration. Above-mentioned numbers may not be limited in the present disclosure. During an implementation, the number of the phase shift unit rows 50H and the first conductive portions 101 in the scanning antenna 000 may be selected and configured according to actual requirements, which may not be described in detail in one embodiment. In one embodiment, each first conductive portion 101 may be a serpentine bending shape as an example for illustration. The first conductive portion 101 may not be limited to such shape and may also be a microstrip line structure of other shape, which may not be described in detail in one embodiment.

Figure 46:
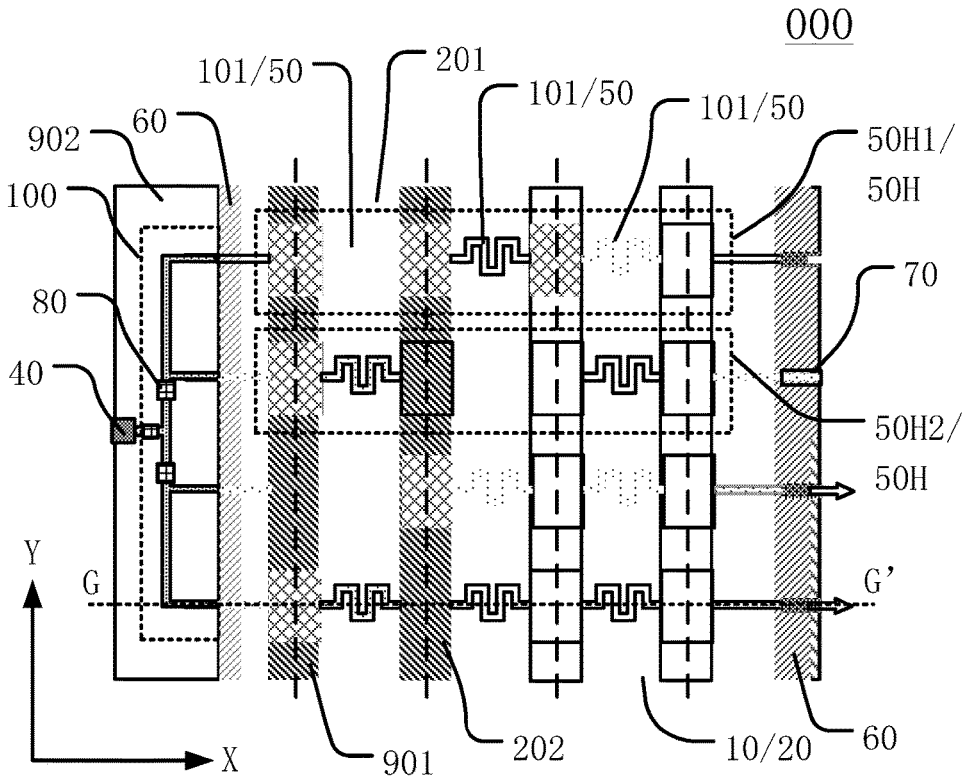
FIG. 46 illustrates another planar structural schematic of an exemplary scanning antenna according to various embodiments of the present disclosure.
Figure 47:
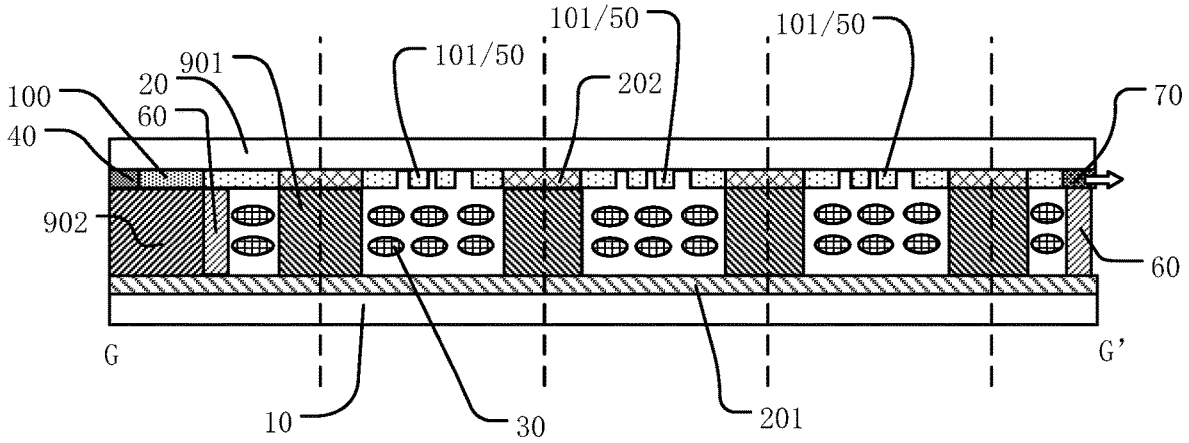
FIG. 47 illustrates a cross-sectional structural schematic along a G-G' direction in FIG. 46.

In some optional embodiments, referring to FIGS. 46-47, FIG. 46 illustrates another planar structural schematic of an exemplary scanning antenna according to various embodiments of the present disclosure; and FIG. 47 illustrates a cross-sectional structural schematic along a G-G' direction in FIG. 46 (it should be understood that, in order to clearly illustrate the structure of one embodiment, transparency filling may be performed in FIG. 46). In one embodiment, the second dielectric layer 902 may be further included between the first substrate 10 and the second substrate 20; the orthographic projection of the second dielectric layer 902 on the first substrate 10 may overlap the orthographic projection of the feed signal access terminal 40 on the first substrate 10; and the orthographic projection of the feed signal access terminal 40 on the first substrate 10 may not overlap the orthographic projection of the liquid crystal layer 30 on the first substrate 10.

The second dielectric layer 902 may include air and/or a solid dielectric.

In one embodiment, it describes that when all phase shift unit rows 50H are electrically connected to the feed signal access terminal 40, the electrical lengths of the electrical connection lines between each other may be different. For example, the electrical length between one phase shift unit row 50H1 and the feed signal access terminal 40 in FIGS. 46-47 may be greater than the electrical length between another phase shift unit row 50H2 and the feed signal access terminal 40, and the electrical length difference may be likely to cause phase difference. Therefore, in order to prevent phase difference between the phase shift unit rows 50H having a parallel relationship, in one embodiment, the second dielectric layer 902 may be disposed at the position of the feed signal access terminal 40 between the first substrate 10 and the second substrate 20, that is, the orthographic projection of the second dielectric layer 902 on the first substrate 10 may overlap the orthographic projection of the feed signal access terminal 40 on the first substrate 10. Optionally, the second dielectric layer 902 may also disposed at the position of the power divider 100 (to realize one-to-multiple signal transmission function) where the feed signal access terminal 40 is connected to each phase shift unit row 50H. The orthographic projection of the feed signal access terminal 40 on the first substrate 10 may not overlap the orthographic projection of the liquid crystal layer 30 on the first substrate 10. The material of the second dielectric layer 902 may be a low-loss material, such as air, or a solid dielectric, or may also be a mixed material of air and a solid dielectric, which may not be limited in one embodiment, as long as the second dielectric layer 902 is a low-loss material. Optionally, the material of the second dielectric layer 902 may exclude the frame adhesive 60. The material of the frame adhesive 60 has a large signal loss, such that the position of the power divider 100 where the feed signal access terminal 40 is connected to all phase shift unit rows 50H should avoid of disposing the frame adhesive 60, which may be beneficial for enhancing the antenna gain and avoiding signal loss. In one embodiment, the first dielectric layer 901 may be disposed in the region corresponding to the third conductive portion 202 of the radiation patch, such that the liquid crystal molecules of the liquid crystal layer 30 may avoid appearing in the region where the radiation patch is located, which may prevent the dielectric change of the liquid crystal from affecting the resonant frequency of the radiation patch; and the second dielectric layer 902 may be further disposed in the region corresponding to the feed signal access terminal 40 and the power divider 100, such that the liquid crystal molecules of the liquid crystal layer 30 may be prevented from appearing in such region, thereby preventing the phase difference between the phase shift unit rows 50H having a parallel relationship and improving the scanning effect of the antenna.

It can be seen from above-mentioned embodiments that the scanning antenna provided by the present disclosure may achieve at least the following beneficial effects.

In the present disclosure, the phase shift units in the scanning antenna may be connected with each other, only one bias voltage line may be needed to provide a same bias voltage signal to all phase shift units, and the overall liquid crystal dielectric constant may be changed by the bias voltage signal. Since the change is the overall liquid crystal dielectric constant in the scanning antenna, it is necessary to configure the length of the feed path at this point. That is, although all phase shift units of the present disclosure are connected with each other, the electrical lengths between at least two phase shift units and the feed signal input terminal may be different. Different electrical lengths may be understood that the lengths between two phase shift units and the feed signal access terminal for realizing the electrical connection may be different. Therefore, the physical path lengths of the microwave signals fed into all radiators may be inconsistent, showing an arithmetic relationship. That is, an initial phase difference may be provided to each microwave signal, such that the phase difference may be adjustable, thereby realizing the wave beam scanning finally. In the present disclosure, only a same bias voltage may be provided to each phase shift unit, and there is no need to independently apply a bias voltage to each phase shift unit, such that the configuration of the bias voltage line may be greatly simplified. Theoretically, only one bias voltage line may need to be provided at the metal layer where the phase shift units are located, and the design difficulty and cost of the liquid crystal bias control circuit may also be greatly reduced. In the present disclosure, only a same bias voltage may be provided to each phase shift unit, and there is no need to independently apply a bias voltage to each phase shift unit. Therefore, the feed signal access terminal and each phase shift unit may be directly connected, which may avoid the problems of coupling loss and reduced working bandwidth. The present disclosure may not only realize one-dimensional wave beam scanning, but also have desirable scanning effect, which is beneficial for reducing production costs and wiring difficulty and can be applied to scenes such as high-speed trains, subway lines, and the like.

Although some embodiments of the present disclosure have been described in detail through examples, those skilled in the art should understand that the above-mentioned embodiments are only for illustration and not for limiting the scope of the present disclosure. Those skilled in the art should understand that the above-mentioned embodiments may be modified without departing from the scope and spirit of the present disclosure. The scope of the present disclosure may be defined by the appended claims.

What is claimed is:

1. A scanning antenna, comprising:

a first substrate and a second substrate, which are arranged oppositely;

a liquid crystal layer, between the first substrate and the second substrate;

a feed signal access terminal and a plurality of phase shift units, wherein the plurality of phase shift units is connected with each other, each phase shift unit is connected to the feed signal access terminal, and at least two phase shift units of the plurality of phase shift units have different electrical lengths with the feed signal access terminal; and a load, wherein one end of the plurality of phase shift units which are connected with each other is connected to the feed signal access terminal, and the other end of the plurality of phase shift units which are connected with each other is connected to the load, and the load is one of a matched wave absorbing structure or a matched wave absorbing circuit component configured to absorb microwaves reaching the other end of the plurality of phase shift units.

2. A scanning antenna, comprising:

a first substrate and a second substrate, which are arranged oppositely;

a liquid crystal layer, between the first substrate and the second substrate; and a feed signal access terminal and a plurality of phase shift units, wherein the plurality of phase shift units is connected with each other, each phase shift unit is connected to the feed signal access terminal, and at least two phase shift units of the plurality of phase shift units have different electrical lengths with the feed signal access terminal, wherein:

each phase shift unit includes a first conductive portion disposed on a side of the first substrate facing the second substrate;

a second conductive portion is disposed on a side of the second substrate facing the first substrate; and the second conductive portion includes a plurality of through holes; and a plurality of third conductive portions is disposed on a side of the second substrate away from the first substrate; an orthographic projection of a third conductive portion on the second substrate overlaps an orthographic projection of a through hole on the second substrate; wherein:

a feed signal received by the feed signal access terminal is transmitted to the first conductive portion, and the first conductive portion couples the feed signal to the third conductive portion through the through hole of the second conductive portion.

3. The scanning antenna according to claim 2, wherein:

the second conductive portion is connected to a ground signal; and the third conductive portion is a block-shaped structure.

4. The scanning antenna according to claim 2, wherein:

the first conductive portion has one of a linear line shape, a curved line shape, and a zigzag line shape.

5. The scanning antenna according to claim 2, wherein:

along a direction in parallel with a plane of the first substrate, a plurality of first conductive portions is arranged sequentially along a same direction and connected with each other; and electrical lengths of two adjacent first conductive portions are equal to each other.

6. The scanning antenna according to claim 2, wherein:

the scanning antenna includes a plurality of phase shift unit rows;

a plurality of first conductive portions is arranged sequentially along a first direction and connected with each other to form one phase shift unit row;

the plurality of phase shift unit rows is sequentially arranged along a second direction, wherein along a direction in parallel with a plane of the first substrate, the first direction intersects the second direction; and one end of each phase shift unit row is connected to the feed signal access terminal.

7. The scanning antenna according to claim 6, wherein:

a dielectric layer is further included between the first substrate and the second substrate;

an orthographic projection of the dielectric layer on the first substrate overlaps an orthographic projection of the feed signal access terminal on the first substrate; and the orthographic projection of the feed signal access terminal on the first substrate does not overlap an orthographic projection of the liquid crystal layer on the first substrate; and the dielectric layer includes air and/or a solid dielectric.

8. The scanning antenna according to claim 2, wherein:

the scanning antenna includes at least two first conductive portions; and a linear distance from one of two first conductive portions to the feed signal access terminal is equal to a linear distance from another one of the two first conductive portions to the feed signal access terminal; and an electrical length from one of the two first conductive portions to the feed signal access terminal is different from an electrical length from another one of the two first conductive portions to the feed signal access terminal.

9. The scanning antenna according to claim 8, wherein:

a transmission path length from one of the two first conductive portions to the feed signal access terminal is different from a transmission path length from another one of the two first conductive portions to the feed signal access terminal.

10. The scanning antenna according to claim 8, wherein:

a transmission path length from one of the two first conductive portions to the feed signal access terminal is same as a transmission path length from another one of the two first conductive portions to the feed signal access terminal; and and shapes of orthographic projections of the two first conductive portions on the first substrate are different.

11. The scanning antenna according to claim 2, wherein:

at least two first branch structures are connected to the feed signal access terminal; at least two second branch structures are connected to each first branch structure; and at least two first conductive portions are connected to each second branch structure;

a plurality of first conductive portions is arranged in an array; and all first conductive portions have a same linear distance with the feed signal access terminal; and the at least two first conductive portions have different electrical lengths with the feed signal access terminal.

12. A scanning antenna, comprising:

a first substrate and a second substrate, which are arranged oppositely;

a liquid crystal layer, between the first substrate and the second substrate; and a feed signal access terminal and a plurality of phase shift units, wherein the plurality of phase shift units is connected with each other, each phase shift unit is connected to the feed signal access terminal, and at least two phase shift units of the plurality of phase shift units have different electrical lengths with the feed signal access terminal, wherein:

each phase shift unit includes a first conductive portion disposed on a side of the second substrate facing the first substrate;

a second conductive portion is disposed on a side of the first substrate facing the second substrate; and the side of the second substrate facing the first substrate includes a third conductive portion connected to the first conductive portion, wherein:

a feed signal received by the feed signal access terminal is transmitted to the first conductive portion, and the first conductive portion transmits the feed signal to the third conductive portion, such that for the plurality of phase shift units, the feed signal is transmitted from first conductive portions to third conductive portions at different positions.

13. The scanning antenna according to claim 12, wherein: the second conductive portion is connected to a ground signal; and the third conductive portion is a block-shaped structure.

14. The scanning antenna according to claim 12, wherein: a first dielectric layer is further included between the first substrate and the second substrate; an orthographic projection of the first dielectric layer on the first substrate overlaps an orthographic projection of the third conductive portion on the first substrate; and the orthographic projection of the first dielectric layer on the first substrate does not overlap an orthographic projection of the liquid crystal layer on the first substrate; and the first dielectric layer includes air and/or a solid dielectric.

15. The scanning antenna according to claim 12, wherein: the first conductive portion has one of a linear line shape, a curved line shape, and a zigzag line shape.

16. The scanning antenna according to claim 12, wherein: a plurality of first conductive portions and a plurality of third conductive portions are arranged sequentially along a same direction and connected with each other; a first conductive portion is between two adjacent third conductive portions; and one end of the first conductive portion is connected to one third conductive portion, and the other end of the first conductive portion is connected to another third conductive portion.

17. The scanning antenna according to claim 12, wherein: a plurality of first conductive portions is arranged sequentially along a same direction and connected with each other;

a branch line is included between two adjacent first conductive portions; the third conductive portion is connected to a first conductive portion of the two adjacent first conductive portions through the branch line; and one end of the branch line is connected to the first conductive portion at a position between the two adjacent first conductive portions, and the other end of the branch line is connected to the third conductive portion.

18. The scanning antenna according to claim 12, wherein: the scanning antenna includes a plurality of phase shift unit rows;

a plurality of first conductive portions is arranged sequentially along a first direction and connected with each other to form one phase shift unit row;

the plurality of phase shift unit rows is sequentially arranged along a second direction, wherein along a direction in parallel with a plane of the first substrate, the first direction intersects the second direction; and one end of each phase shift unit row is connected to the feed signal access terminal.

19. The scanning antenna according to claim 12, wherein: a second dielectric layer is further included between the first substrate and the second substrate; an orthographic projection of the second dielectric layer on the first substrate overlaps an orthographic projection of the feed signal access terminal on the first substrate; and the orthographic projection of the feed signal access terminal on the first substrate does not overlap an orthographic projection of the liquid crystal layer on the first substrate; and the second dielectric layer includes air and/or a solid dielectric.

* * * * *